US009462378B2

(12) United States Patent
Kuech et al.

(10) Patent No.: US 9,462,378 B2
(45) Date of Patent: Oct. 4, 2016

(54) APPARATUS AND METHOD FOR DERIVING A DIRECTIONAL INFORMATION AND COMPUTER PROGRAM PRODUCT

(71) Applicant: Fraunhofer-Gesellschaft zur Foerderung der angewandten Forschung e.V., Munich (DE)

(72) Inventors: Fabian Kuech, Erlangen (DE); Giovanni Del Galdo, Heroldsberg (DE); Oliver Thiergart, Fuerth (DE); Ville Pulkki, Espoo (FI); Jukka Ahonen, Espoo (FI)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 475 days.

(21) Appl. No.: 13/867,304

(22) Filed: Apr. 22, 2013

(65) Prior Publication Data

US 2013/0230187 A1 Sep. 5, 2013

Related U.S. Application Data

(63) Continuation of application No. PCT/EP2011/068805, filed on Oct. 26, 2011.

(60) Provisional application No. 61/407,574, filed on Oct. 28, 2010.

(30) Foreign Application Priority Data

May 20, 2011 (EP) ..... 11166916

(51) Int. Cl.
*H04R 3/00* (2006.01)

(52) U.S. Cl.
CPC ..... *H04R 3/005* (2013.01); *H04S 2400/15* (2013.01); *H04S 2420/05* (2013.01)

(58) Field of Classification Search
None
See application file for complete search history.

(56) References Cited

U.S. PATENT DOCUMENTS 4,042,779 A 8/1977 Craven et al.
4,752,961 A 6/1988 Kahn (Continued)

FOREIGN PATENT DOCUMENTS

JP 2002-84590 A 3/2002
JP 2004-279390 A 10/2004

(Continued)

OTHER PUBLICATIONS

Chen, J. et. al., "Time Delay Estimation in Room Acoustic Environments: An Overview", EURASIP Journal on Applied Signal Processing, vol. 2006, Article ID 26503, pp. 1-19.

(Continued)

*Primary Examiner* — Curtis Kuntz
*Assistant Examiner* — Qin Zhu
(74) *Attorney, Agent, or Firm* — Keating & Bennett, LLP

(57) ABSTRACT

An apparatus for deriving a directional information from a plurality of microphone signals or from a plurality of components of a microphone signal, wherein different effective microphone look directions are associated with the microphone signals or components, has a combiner configured to obtain a magnitude value from a microphone signal or a component of the microphone signal. The combiner is further configured to combine direction information items describing the effective microphone look directions, such that a direction information item describing a given effective microphone look direction is weighted in dependence on the magnitude value of the microphone signal, or of the component of the microphone signal, associated with the given effective microphone look direction, to derive the directional information.

15 Claims, 16 Drawing Sheets

(56) References Cited

U.S. PATENT DOCUMENTS

| | | | | |
|---|---|---|---|---|
| 5,581,620 | A | 12/1996 | Brandstein et al. | |
| 7,561,701 | B2 | 7/2009 | Fischer | |
| 2004/0175006 | A1 | 9/2004 | Kim et al. | |
| 2004/0240681 | A1 | 12/2004 | Fischer | |
| 2005/0201204 | A1* | 9/2005 | Dedieu et al. | 367/118 |
| 2008/0170716 | A1* | 7/2008 | Zhang | 381/92 |
| 2008/0240463 | A1 | 10/2008 | Florencio et al. | |
| 2008/0247565 | A1* | 10/2008 | Elko et al. | 381/92 |
| 2009/0003621 | A1 | 1/2009 | Greywall | |
| 2009/0175466 | A1 | 7/2009 | Elko et al. | |
| 2010/0061568 | A1* | 3/2010 | Rasmussen | 381/94.1 |
| 2010/0109951 | A1 | 5/2010 | Taenzer | |
| 2011/0103601 | A1 | 5/2011 | Hanyu | |

FOREIGN PATENT DOCUMENTS

| | | | |
|---|---|---|---|
| JP | 2009-89315 | A | 4/2009 |
| JP | 2009-216747 | A | 9/2009 |
| RU | 2 048 678 | C1 | 11/1995 |
| TW | 200904226 | A | 1/2009 |
| WO | 2009/077152 | A1 | 6/2009 |
| WO | 2009/153053 | A1 | 12/2009 |

OTHER PUBLICATIONS

Faller, C., "Microphone Front-Ends for Spatial Audio Coders", Audio Engineering Society, 125th Convention, Paper 7508, Oct. 2008, San Francisco, California, pp. 1-10.

Gerzon, M.A., "Periphony: With-Height Sound Reproduction", Journal of Audio Engineering Society, vol. 21, No. 1, 1973, pp. 2-8, Oxford, England.

Kallinger, M. et. al., "Analysis and Adjustment of Planar Microphone Arrays for Application in Directional Audio Coding", Audio Engineering Society, 124th Convention, Paper 7374, May 2008, Amsterdam, The Netherlands, pp. 1-12.

Kallinger, M. et. al., "A Spatial Filtering Approach for Directional Audio Coding", Audio Engineering Society, 126th Convention, Paper 7653, May 2009, Munich, Germany, pp. 1-10.

Pulkki, V., "Spatial Sound Reproduction with Directional Audio Coding", Journal of Audio Engineering Society, vol. 55, No. 6, 2007, pp. 503-516, Helsinki, Finland.

Schmidt, R., "Multiple Emitter Location and Signal Parameter Estimation", IEEE Transactions on Antennas and Propagation, vol. AP-34, No. 3, pp. 276-280, Mar. 1986.

Teutsch, H. et. al., "Acoustic Source Detection and Localization Based on Wavefield Decomposition Using Circular Microphone Arrays", Journal Acoustical Society of America, vol. 120, No. 5, Nov. 2006, pp. 2724-2736, Erlangen, Germany.

Thiergart, O. et. al., "Localization of Sound Sources in Reverberant Environments Based on Directional Audio Coding Parameters", Audio Engineering Society, 127th Convention, Paper 7853, Oct. 2009, New York, New York, pp. 1-14.

Baumgarte, F. et. al., "Binaural Cue Coding—Part I: Psychoacoustic Fundamentals and Design Principles", IEEE Transactions on Speech and Audio Processing, vol. 11, No. 6, Nov. 2003, pp. 509-519.

Goodwin, M. et. al., "Analysis and Synthesis for Universal Spatial Audio Coding", Audio Engineering Society, 121st Convention, Paper 6874, Oct. 2006, San Francisco, California, pp. 1-11.

Kallinger, M. et. al., "Spatial Filtering Using Directional Audio Coding Parameters", IEEE International Conference Acoustics, Speech and Signal Processing, 2009, pp. 217-220.

Merimaa, J., "Applications of a 3-D Microphone Array", Audio Engineering Society, 112th Convention, Paper 5501, May 2002, Munich, Germany, pp. 1-11.

Gerzon, M.A., "The Design of Precisely Coincident Microphone Arrays for Stereo and Surround Sound", Audio Engineering Society, 50th Convention, 1975, Oxford, England, 5 pages.

Eargle, J., "The Microphone Book", Focal Press, 2001, Boston, Massachusetts, pp. 19-21.

Official Communication issued in corresponding Russian Patent Application No. 2013124400 mailed on Jan. 12, 2015.

Official Communication issued in corresponding Taiwanese Patent Application No. 100137945, mailed on Jun. 18, 2014.

Official Communication issued in corresponding Japanese Patent Application No. 2013-535425, mailed on Jun. 10, 2014.

Official Communication issued in corresponding Korean Patent Application No. 10-2013-7013550, mailed on Feb. 2, 2015.

* cited by examiner

SINGLE MICROPHONE

PRESSURE GRADIENT

ENERGY GRADIENT

SINGLE MICROPHONE

PRESSURE GRADIENT

ENERGY GRADIENT

G.R.A.S. and 2 cm spacing in an array

AKG and 3.3 cm spacing in an array

APPARATUS AND METHOD FOR DERIVING A DIRECTIONAL INFORMATION AND COMPUTER PROGRAM PRODUCT

CROSS-REFERENCE TO RELATED APPLICATIONS

This application is a continuation of copending International Application No. PCT/EP2011/068805, filed Oct. 28, 2010, which is incorporated herein by reference in its entirety, and additionally claims priority from U.S. Application No. 61/407,574, filed Oct. 28, 2010 and European Application Number EP 11 166 916.4, filed May 20, 2011, all of which are incorporated herein by reference in their entirety.

BACKGROUND OF THE INVENTION

Embodiments of the present invention relate to an apparatus for deriving a directional information from a plurality of microphone signals or from a plurality of components of a microphone signal. Further embodiments relate to systems comprising such an apparatus. Further embodiments relate to a method for deriving a directional information from a plurality of microphone signals.

Spatial sound recording aims at capturing a sound field with multiple microphones such that at the reproduction side, a listener perceives the sound image as it was present at the recording location. Standard approaches for spatial sound recording use conventional stereo microphones or more sophisticated combinations of directional microphones, e.g., such as the B-format microphones used in Ambisonics (M. A. Gerzon. Periphony, Width-height sound reproduction, J. Audio Eng. Soc., 21(1):2-10, 1973). Commonly, most of these methods are referred to as coincident-microphone techniques.

Alternatively, methods based on a parametric representation of sound fields can be applied, which are referred to as parametric spatial audio coders. These methods determine one or more downmix audio signals together with corresponding spatial side information, which are relevant for the perception of spatial sound. Examples are Directional Audio Coding (DirAC), as discussed in V. Pulkki, Spatial sound reproduction with directional audio coding, J. Audio Eng. Soc., 55(6):503-516, June 2007, or the so-called spatial audio microphones (SAM) approach proposed in C. Faller, Microphone front-ends for spatial audio coders. In 125th AES Convention, Paper 7508, San Francisco, October 2008. The spatial cue information is determined in frequency subbands and basically consists of the direction-of-arrival (DOA) of sound and, sometimes, of the diffuseness of the sound field or other statistical measures. In a synthesis stage, the desired loudspeaker signals for reproduction are determined based on the downmix signals and the parametric side information.

In addition to spatial audio recording, parametric approaches to sound field representations have been used in applications such as directional filtering (M. Kallinger, H. Ochsenfeld, G. Del Galdo, F. Kuech, D. Mahne, R. Schultz-Amling, and O. Thiergart, A spatial filtering approach for directional audio coding, in 126th AES Convention, Paper 7653, Munich, Germany, May 2009) or source localization (O. Thiergart, R. Schultz-Amling, G. Del Galdo, D. Mahne, and F. Kuech, Localization of sound sources in reverberant environments based on directional audio coding parameters, in 128th AES Convention, Paper 7853, New York City, N.Y., USA, October 2009). These techniques are also based on directional parameters such as DOA of sound or the diffuseness of the sound field.

One way to estimate directional information from the sound field, namely the direction of arrival of sound, is to measure the field in different points with an array of microphones. Several approaches have been proposed in the literature J. Chen, J. Benesty, and Y. Huang, Time delay estimation in room acoustic environments: An overview, in EURASIP Journal on Applied Signal Processing, Article ID 26503, 2006 using relative time delay estimates between the microphone signals. However, these approaches make use of the phase information of the microphone signals, leading inevitably to spatial aliasing. In fact, as higher frequencies are being analyzed, the wavelength becomes shorter. At a certain frequency, termed aliasing frequency, the wavelength is such that the identical phase readings correspond to two or more directions, so that an unambiguous estimation is not possible (at least without additional a priori information).

There exists a large variety of methods to estimate the DOA of sound using arrays of microphones. An overview of common approaches is summarized in J. Chen, J. Benesty, and Y. Huang, Time delay estimation in room acoustic environments: An overview, in EURASIP Journal on Applied Signal Processing, Article ID 26503, 2006. These approaches have in common, that they exploit the phase relation of the microphone signals to estimate the DOA of sound. Often, the time difference between different sensors is determined first, and then the knowledge of the array geometry is exploited to compute the corresponding DOA. Other approaches evaluate the correlation between the different microphone signals in frequency subbands to estimate the DOA of sound (C. Faller, Microphone front-ends for spatial audio coders, in 125th AES Convention, Paper 7508, San Francisco, October 2008 and J. Chen, J. Benesty, and Y. Huang, Time delay estimation in room acoustic environments: An overview, in EURASIP Journal on Applied Signal Processing, Article ID 26503, 2006).

In DirAC the DOA estimate for each frequency band is determined based on the active sound intensity vector measured in the observed sound field. In the following the estimation of the directional parameters in DirAC is briefly summarized. Let P(k, n) denote the sound pressure and U(k, n) the particle velocity vector at frequency index k and time index n. Then, the active sound intensity vector is obtained as $$I_a(k, n) = \frac{1}{2\rho_0}\mathrm{Re}\{P(k, n)U*(k, n)\} \tag{1}$$

The superscript * denotes the conjugate complex and Re{ } is the real part of a complex number. $\rho_0$ represents the mean density of air. Finally, the opposite direction of $I_a(k, n)$ points to the DOA of sound:

$$e_{DOA}(k, n) = -\frac{I_a(k, n)}{\|I_a(k, n)\|}. \tag{2}$$

Additionally, the diffuseness of the sound field can be determined, e.g., according to $$\Psi(k, n) = \sqrt{1 - \frac{\|E\{I_a(k, n)\}\|}{E\{\|I_a(k, n)\|\}}}. \tag{3}$$

In practice, the particle velocity vector is computed from the pressure gradient of closely spaced omnidirectional microphone capsules, often referred to as differential microphone array. Considering FIG. 2, the x component of the particle velocity vector can, e.g., be computed using a pair of microphones according to $$U_x(k,n)=K(k)[P_1(k,n)-P_2(k,n)], \tag{4}$$

where K(k) represents a frequency dependent normalization factor. Its value depends on the microphone configuration, e.g. the distance of the microphones and/or their directivity patterns. The remaining components $U_y(k, n)$ (and $U_z(k, n)$) of U(kn) can be determined analogously by combining suitable pairs of microphones.

As shown in M. Kallinger, F. Kuech, R. Schultz-Amling, G. Del Galdo, J. Ahonen, and V. Pulkki, Analysis and Adjustment of Planar Microphone Arrays for Application in Directional Audio Coding, in 124th AES Convention, Paper 7374, Amsterdam, the Netherlands, May 2008, spatial aliasing affects the phase information of the particle velocity vector, prohibiting the use of pressure gradients for the active sound intensity estimation at high frequencies. This spatial aliasing yields ambiguities in the DOA estimates. As can be shown, the maximum frequency $f_{max}$, where unambiguous DOA estimates can be obtained based on active sound intensity, is determined by the distance of the microphone pairs. Additionally, the estimation of directional parameters such as diffuseness of a sound field are also affected. In case of omnidirectional microphones with a distance d, this maximum frequency is given by $$f_{max} = \sqrt{\frac{1}{2}}\,\frac{c}{d}, \tag{5}$$

where c denotes the speed of sound propagation.

Typically, the needed frequency range of applications exploiting the directional information of sound fields is larger than the spatial aliasing limit $f_{max}$ to be expected for practical microphone configuration. Notice that reducing the microphone spacing d, which increases the spatial aliasing limit $f_{max}$, is not a feasible solution for most applications, as a too small d significantly reduces the estimation reliability at low frequencies in practice. Thus, new methods are needed to overcome the limitations of current directional parameter estimation techniques at high frequencies.

SUMMARY

According to an embodiment, an apparatus for deriving a directional information from a plurality of microphone signals or from a plurality of components of a microphone signal, wherein different effective microphone look directions are associated with the microphone signals or components, may have a combiner configured to acquire a magnitude value from a microphone signal or a component of the microphone signal, and to combine direction information items describing the effective microphone look directions, such that a direction information item describing a given effective microphone look direction is weighted in dependence on the magnitude value of the microphone signal, or of the component of the microphone signal, associated with the given effective microphone look direction, to derive the directional information; wherein a direction information item describing a given effective microphone look direction is a vector pointing in the given effective microphone look direction; wherein the combiner is configured to derive the directional information d(k, n) for a given time frequency tile corresponding to a linear combination of the direction information items weighted in dependence on magnitude values being associated to the given time frequency tile; and wherein the direction information items are independent from time frequency tiles.

According to another embodiment, a system may have an apparatus for deriving a directional information from a plurality of microphone signals or from a plurality of components of a microphone signal, wherein different effective microphone look directions are associated with the microphone signals or components, wherein the apparatus may have a combiner configured to acquire a magnitude value from a microphone signal or a component of the microphone signal, and to combine direction information items describing the effective microphone look directions, such that a direction information item describing a given effective microphone look direction is weighted in dependence on the magnitude value of the microphone signal, or of the component of the microphone signal, associated with the given effective microphone look direction, to derive the directional information; wherein a direction information item describing a given effective microphone look direction is a vector pointing in the given effective microphone look direction; wherein the combiner is configured to derive the directional information d(k, n) for a given time frequency tile corresponding to a linear combination of the direction information items weighted in dependence on magnitude values being associated to the given time frequency tile; and wherein the direction information items are independent from time frequency tiles, a first directional microphone having a first effective microphone look direction for deriving a first microphone signal of the plurality of microphone signals, the first microphone signal being associated with a first effective microphone look direction; and a second directional microphone having a second effective microphone look direction for deriving a second microphone signal of the plurality of microphone signals, the second microphone signal being associated with the second effective microphone look direction; and wherein the first look direction is different from the second look direction.

According to another embodiment, a system may have an apparatus for deriving a directional information from a plurality of microphone signals or from a plurality of components of a microphone signal, wherein different effective microphone look directions are associated with the microphone signals or components, wherein the apparatus may have a combiner configured to acquire a magnitude value from a microphone signal or a component of the microphone signal, and to combine direction information items describing the effective microphone look directions, such that a direction information item describing a given effective microphone look direction is weighted in dependence on the magnitude value of the microphone signal, or of the component of the microphone signal, associated with the given effective microphone look direction, to derive the directional information; wherein a direction information item describing a given effective microphone look direction is a vector pointing in the given effective microphone look direction; wherein the combiner is configured to derive the directional information d(k, n) for a given time frequency tile corresponding to a linear combination of the direction information items weighted in dependence on magnitude values being associated to the given time frequency tile; and wherein the direction information items are independent from time frequency tiles, a first omnidirectional microphone for deriving a first microphone signal of the plurality of microphone signals; a second omnidirectional microphone for deriving a second microphone signal; and a shadowing object placed between the first omnidirectional microphone and the second omnidirectional microphone for shaping effective response patterns of the first omnidirectional microphone and of the second omnidirectional microphone, such that a shaped effective response pattern of the first omnidirectional microphone has a first effective microphone look direction and a shaped effective response pattern of the second omnidirectional microphone has a second effective microphone look direction, being different from the first effective microphone look direction.

According to another embodiment, a method for deriving a directional information from a plurality of microphone signals or from a plurality of components of a microphone signal, wherein different effective microphone look directions are associated with the microphone signals or the components, may have the steps of acquiring a magnitude value from the microphone signal or a component of the microphone signal; and combining direction information items describing the effective microphone look directions, such that a direction information item describing a given effective microphone look direction is weighted in dependence on the magnitude value of the microphone signal or of the component of the microphone signal associated with the given effective microphone look direction, to derive the directional information; wherein a direction information item describing a given effective microphone look direction is a vector pointing in the given effective microphone look direction; wherein the directional information for a given time frequency tile is derived corresponding to a linear combination of the direction information items weighted in dependence on magnitude values being associated to the given time frequency tile; and wherein the direction information items are independent from time frequency tiles.

According to another embodiment, a computer program may have a program code for, when running on a computer, performing the method for deriving a directional information from a plurality of microphone signals or from a plurality of components of a microphone signal, wherein different effective microphone look directions are associated with the microphone signals or the components, wherein the method may have the steps of acquiring a magnitude value from the microphone signal or a component of the microphone signal; and combining direction information items describing the effective microphone look directions, such that a direction information item describing a given effective microphone look direction is weighted in dependence on the magnitude value of the microphone signal or of the component of the microphone signal associated with the given effective microphone look direction, to derive the directional information; wherein a direction information item describing a given effective microphone look direction is a vector pointing in the given effective microphone look direction; wherein the directional information for a given time frequency tile is derived corresponding to a linear combination of the direction information items weighted in dependence on magnitude values being associated to the given time frequency tile; and wherein the direction information items are independent from time frequency tiles.

Embodiments provide an apparatus for deriving a directional information from a plurality of microphone signals or from a plurality of components of a microphone signal, wherein different effective microphone look directions are associated with the microphone signals or components. The apparatus comprises a combiner configured to obtain a magnitude from a microphone signal or a component of the microphone signal. Furthermore, the combiner is configured to combine (e.g. linearly combine) direction information items describing the effective microphone look direction, such that a direction information item describing a given effective microphone look direction is weighted in dependence on the magnitude value of the microphone signal, or of the component of the microphone signal, associated with the given effective microphone look direction, to derive the directional information.

It has been found that the problem of spatial aliasing in directional parameter estimation results from ambiguities in the phase information within the microphone signals. It is an idea of embodiments of the present invention to overcome this problem by deriving a directional information based on magnitude values of the microphone signals. It has been found that by deriving the directional information based on magnitude values of the microphone signals or of components of the microphone signals, ambiguities, as they may occur in traditional systems using the phase information to determine the directional information do not occur. Hence, embodiments enable a determination of a directional information even above a spatial aliasing limit, above which a determination of the directional information is not (or only with errors) possible using phase information.

In other words, the use of the magnitude values of the microphone signals or of the components of the microphone signals is especially beneficial within frequency regions where spatial aliasing or other phase distortions are expected, since these phase distortions do not have an influence on the magnitude values and, therefore, do not lead to ambiguities in the directional information determination.

According to some embodiments, an effective microphone look direction associated to a microphone signal describes the direction where the microphone from which the microphone signal is derived has its maximum response (or its highest sensitivity). As an example, the microphone may be a directional microphone possessing a non isotropic pick up pattern and the effective microphone look direction can be defined as the direction where the pick up pattern of the microphone has its maximum. Hence, for a directional microphone the effective microphone look direction may be equal to the microphone look direction (describing the direction towards which the directional microphone has a maximum sensitivity), e.g. when no objects modifying the pick-up pattern of the directional microphone are placed near the microphone. The effective microphone look direction may be different to the microphone look direction of the directional microphone if the directional microphone is placed near an object that has the effect of modifying its pick-up pattern. In this case the effective microphone look direction may describe the direction, where the directional microphone has its maximum response.

In the case of an omnidirectional microphone, an effective response pattern of the omnidirectional microphone may be shaped, for example, using a shadowing object (which has an effect of the effect of modifying the pick-up pattern of the microphone), such that the shaped effective response pattern has an effective microphone look direction which is the direction of maximum response of the omnidirectional microphone with the shaped effective response pattern.

According to further embodiments, the directional information may be a directional information of a sound field pointing towards the direction from which the sound field is propagating (for example, at certain frequency and time indices). The plurality of microphone signals may describe the sound field. According to some embodiments, a direction information item describing a given effective microphone look direction maybe a vector pointing into the given effective microphone look direction. According to further embodiments, the direction information items may be unit vectors, such that direction information items associated with different effective microphone look directions have equal norms (but different directions). Therefore, a norm of a weighted vector linearly combined by the combiner is determined by the magnitude value of the microphone signal or the component of the microphone signal associated to the direction information item of the weighted vector.

According to further embodiments, the combiner may be configured to obtain a magnitude value, such that the magnitude value describes a magnitude of a spectral coefficient (as a component of the microphone signal) representing a spectral sub-region of the microphone signal of the component of the microphone signal. In other words, embodiments may extract the actual information of a sound field (for example analyzed in a time frequency domain) from the magnitudes of the spectra of the microphones used for deriving the microphone signals.

According to further embodiments, only the magnitude values (or the magnitude information) of the microphone signals (or of the microphone spectra) are used in the estimation process for deriving the directional information, as the phase term is corrupted by the spatial aliasing effect.

In other words, embodiments create an apparatus and a method for directional parameter estimation using only the magnitude information of microphone signals or components of the microphone signals and the spectrum, respectively.

According to further embodiments, the output of the magnitude based directional parameter estimation (the directional information) can be combined with other techniques which also consider phase information.

According to further embodiments, the magnitude value may describe a magnitude of the microphone signal or of the component.

BRIEF DESCRIPTION OF THE DRAWINGS

Embodiments of the present invention will be detailed subsequently referring to the appended drawings, in which.

Before embodiments of the present invention will be described in more detail using the accompanying figures, it is to be pointed out that the same or functionally equal elements are provided with the same reference numbers and that a repeated description of elements provided with the same reference numbers is omitted. Hence, descriptions provided for elements with the same reference numbers are mutually exchangeable.

DETAILED DESCRIPTION OF THE INVENTION

Figure 1:
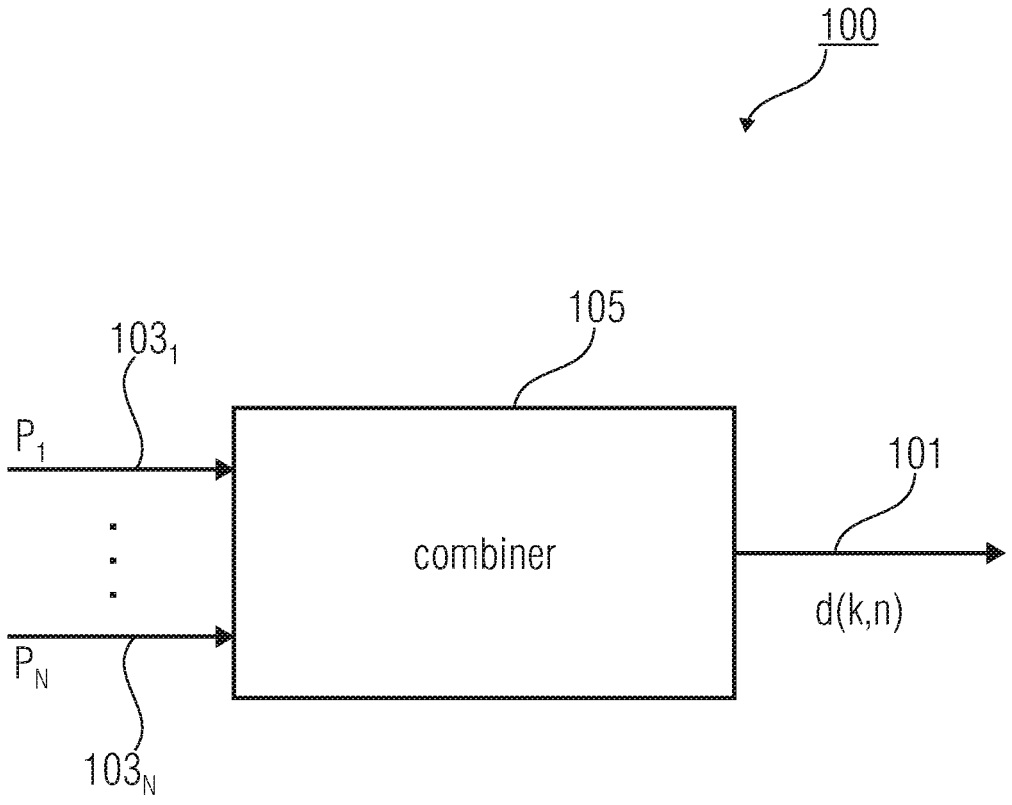
FIG. 1 shows a block schematic diagram of an apparatus according to an embodiment of the present invention.
Figure 2:
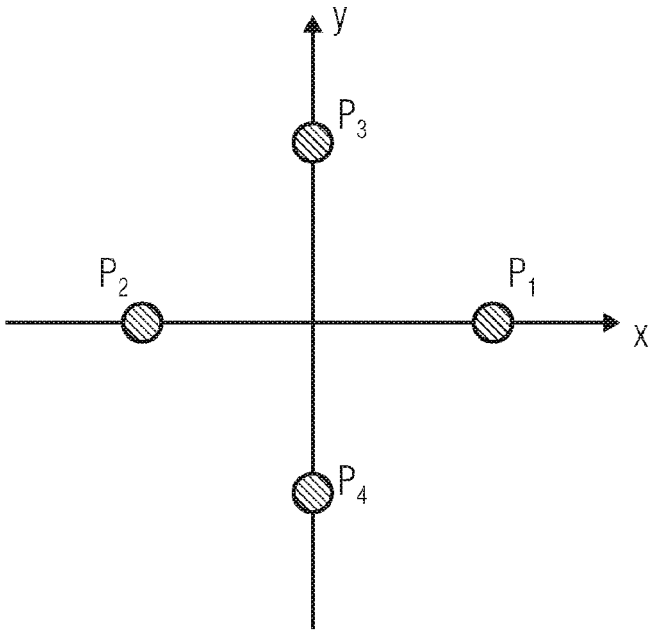
FIG. 2 shows an illustration of a microphone configuration using four omnidirectional capsules; providing sound pressure signals $P_i(k, n)$ with i=1, . . . , 4.

5.1 Apparatus According to FIG. 1

FIG. 1 shows an apparatus 100 according to an embodiment of the present invention. The apparatus 100 for deriving a directional information 101 (also denoted as d(k, n)) from a plurality of microphone signals $\mathbf{103}_1$ to $\mathbf{103}_N$ (also denoted as $P_1$ to $P_N$) or from a plurality of components of a microphone signal comprises a combiner 105. The combiner 105 is configured to obtain a magnitude value from a microphone signal or a component of the microphone signal, and to linearly combine direction information items describing effective microphone look directions being associated with the microphone signals $\mathbf{103}_1$ to $\mathbf{103}_N$ or the components, such that a direction information item describing a given effective microphone look direction is weighted in dependence on the magnitude value of the microphone signal, or of the component of the microphone signal, associated with the given effective microphone look direction to derive the directional information 101.

A component of an i-th microphone signal $P_i$ may be denoted as $P_i(k, n)$. The component $P_i(k, n)$ of the microphone signal $P_i$ may be a value of the microphone signal $P_i$ at frequency index k and time index n. The microphone signal $P_i$ may be derived from an i-th microphone and may be available to the combiner 105 in the time frequency representation comprising a plurality of components $P_i(k, n)$ for different frequency indices k and time indices n. As an example, the microphone signals $P_1$ to $P_N$ may be Sound Pressure Signals, as they can be derived from B-Format microphones.

Therefore, each component $P_i(k, n)$ may correspond to a time frequency tile (k, n). The combiner 105 may be configured to obtain the magnitude value such that the magnitude value describes a magnitude of a spectral coefficient representing a spectral sub-region of the microphone signal $P_i$. This spectral coefficient may be a component $P_i(k, n)$ of the microphone signal $P_i$. The spectral sub-region may be defined by the frequency index k of the component $P_i(k,$ n). Furthermore, the combiner 105 may be configured to derive the directional information 101 on the basis of a time frequency representation of the microphone signals, for example, in which a microphone signal $P_i$ is represented by a plurality of components $P_i(k, n)$, each component being associated to a time frequency tile (k, n).

As described in the introductory part of this application, by obtaining the directional information d(k, n) based on the magnitude values of the microphone signals $P_1$ to $P_N$ or of components of a microphone signal a determination of the directional information d(k, n) even with higher frequency for the microphone signals $P_1$ to $P_N$, e.g. for components $P_i(k, n)$ to $P_N(k, n)$ having a frequency index above a frequency index of the spectral aliasing frequency $f_{max}$, can be achieved, since spatial aliasing or other phase distortions cannot occur.

In the following a detailed example of an embodiment of the present invention is given, which is based on a combination of the magnitudes of the microphone signals (directional magnitude combination), and how it can be performed by the apparatus 100 according to FIG. 1. The directional information d(k, n), also denoted as DOA estimate, is obtained by interpreting the magnitude of each microphone signal (or of each component of a microphone signal) as a corresponding vector in a two-dimensional (2D) or three-dimensional (3D) space.

Let $d_t(k, n)$ be the true or desired vector which points towards the direction from which the sound field is propagating at frequency and time indices k and n respectively. In other words, the DOA of sound corresponds to the direction of $d_t(k, n)$. Estimating $d_t(k, n)$ so that the directional information from the sound field can be extracted is the goal of embodiments of the invention. Let further $b_1, b_2, \ldots, b_N$ be vectors (e.g. unit norm vectors) pointing into the look direction of the N directional microphones. The look direction of a directional microphone is defined as the direction, where the pick-up pattern has its maximum. Analogously, in case of scattering/shadowing objects are included in the microphone configuration, the vectors $b_1, b_2, \ldots, b_N$ point in the direction of maximum response of the corresponding microphone.

The vectors $b_1, b_2, \ldots, b_N$ may be designated as direction information items describing effective microphone look directions of the first to the N-th microphone. In this example, the direction information items are vectors pointing into corresponding effective microphone look directions. According to further embodiments, a direction information item may also be a scalar, for example an angle describing a look direction of a corresponding microphone.

Furthermore, in this example the direction information items may be unit norm vectors, such that vectors associated with different effective microphone look directions have equal norms.

It should also be noted, that the proposed method may work best if the sum of the vectors $b_i$ corresponding to the effective microphone look directions of the microphones, equals zero (e.g. within a tolerance range), i.e., $$\sum_{i=1}^{N} b_i = 0. \tag{6}$$

In some embodiments the tolerance range may be ±30%, ±20%, ±10%, ±5% of one of the direction information items used to derive the sum (e.g. of the direction information item having the largest norm of the direction information item having the smallest norm, or of the direction information item having the norm closest to the average of all norms of the direction items used to derive the sum).

In some embodiments effective microphone look directions may not be equally distributed with regard to a coordinate system. For example, assuming a system in which a first effective microphone look direction of a first microphone is EAST (e.g. 0 degrees in a 2-dimensional coordinate system), a second effective microphone look direction of a second microphone is NORTH-EAST (e.g. 45 degrees in the 2-dimensional coordinate system), a third microphone look direction of a third microphone is NORTH (e.g. 90 degrees in the 2-dimensional coordinate system), and a fourth effective microphone look direction of a fourth microphone is SOUTH-WEST (e.g. −135 degrees in the 2-dimensional coordinate system), having the direction information items being unit norm vectors would result in:

$b_1=[1\ 0]^T$ for the first effective microphone look direction;

$b_2=[1/\sqrt{2}\ 1/\sqrt{2}]^T$ for the second effective microphone look direction;

$b_3=[0\ 1]^T$ for the third effective microphone look direction; and $b_4=[-1/\sqrt{2}\ -1/\sqrt{2}]^T$ for the fourth effective microphone look direction.

This would lead to a non-zero sum of the vectors of:

$$b_{sum}=b_1+b_2+b_3+b_4=[1\ 1]^T.$$

As in some embodiments, it is desired to have a sum of the vectors being zero, a direction information item being a vector pointing into an effective microphone look direction may be scaled. In this example, the direction information item $b_4$ may be scaled, such as:

$$b_4=[-(1+1/\sqrt{2})\ -(1+1/\sqrt{2})]^T$$

resulting in a sum $b_{sum}$ of the vectors being equal to zero:

$$b_{sum}=b_1+b_2+b_3+b_4=[0\ 0]^T.$$

In other words, according to some embodiments, different direction information items being vectors pointing into different effective microphone look directions may have different norms, which may be chosen such that a sum of the direction information items equals zero.

The estimate d of the true vector $d_t(k, n)$, and therefore the directional information to be determined can be defined as $$d(k, n) = \sum_{i=1}^{N} |P_i(k, n)|^{\kappa} \cdot b_i, \tag{7}$$

where $P_i(k, n)$ denotes the signal of the i-th microphone (or of the component of the microphone signal $P_i$ of the i-th microphone) associated to the frequency tile (k, n).

The equation (7) forms a linear combination of the direction information items $b_1$ to $b_N$ of a first microphone to a N-th microphone weighted by magnitude values of components $P_1(k, n)$ to $P_N(k, n)$ of microphone signals $P_1$ to $P_N$ derived from the first to the N-th microphone. Therefore, the combiner 105 may calculate the equation (7) to derive the directional information 101 (d(k, n)).

As can be seen from eq. (7) the combiner 105 may be configured to linearly combine the direction information items $b_1$ to $b_N$ weighted in dependence on the magnitude values being associated to a given time frequency tile (k, n) in order to derive the directional information d(k, n) for the given time frequency tile (k, n).

According to further embodiments, the combiner 105 may be configured to linearly combine the direction information items $b_1$ to $b_N$ weighted only in dependence on the magnitude values being associated to the given time frequency tile (k, n).

Furthermore, from equation (7) it can be seen that the combiner 105 may be configured to linearly combine for a plurality of different time frequency tiles the same directional information items $b_1$ to $b_N$ (as these are independent from the time frequency tiles) describing different effective microphone look directions, but the direction information items may be weighted differently in dependence on the magnitude values associated to the different time frequency tiles.

As the direction information items $b_1$ to $b_N$ may be unit vectors a norm of a weighted vector being formed by a multiplication of a direction information item $b_i$ and a magnitude value may be defined by the magnitude value. Weighted vectors for the same effective microphone look direction but different time frequency tiles may have the same direction but differ in their norms due to the different magnitude values for different time frequency tiles.

According to some embodiments, the weighted values may be scalar values.

The factor κ shown in eq. (7) may be chosen freely. In the case that κ=2 and that opposing microphones (from which the microphone signals $P_1$ to $P_N$ are derived from) are equidistant, the directional information d(k, n) is proportional to the energy gradient in the center of the array (for example in a set of two microphones).

In other words the combiner 105 may be configured to obtain squared magnitude values based on the magnitude values, a squared magnitude value describing a power of a component $P_i(k, n)$ of a microphone signal $P_i$. Furthermore, the combiner 105 may be configured to linearly combine the direction information items $b_1$ to $b_N$ such that a direction information item $b_i$ is weighted in dependence on the squared magnitude value of the component $P_i(k, n)$ of the microphone signal $P_i$ associated with the corresponding look direction (of the i-th microphone).

From d(k, n) the directional information expressed with azimuth φ and elevation $\vartheta$ angles is easily obtained considering that $$\frac{d(k,n)}{\|d(k,n)\|} = \begin{bmatrix} \cos(\varphi)\cos(\vartheta) \\ \sin(\varphi)\cos(\vartheta) \\ \sin(\vartheta) \end{bmatrix}. \tag{8}$$

Figure 3:
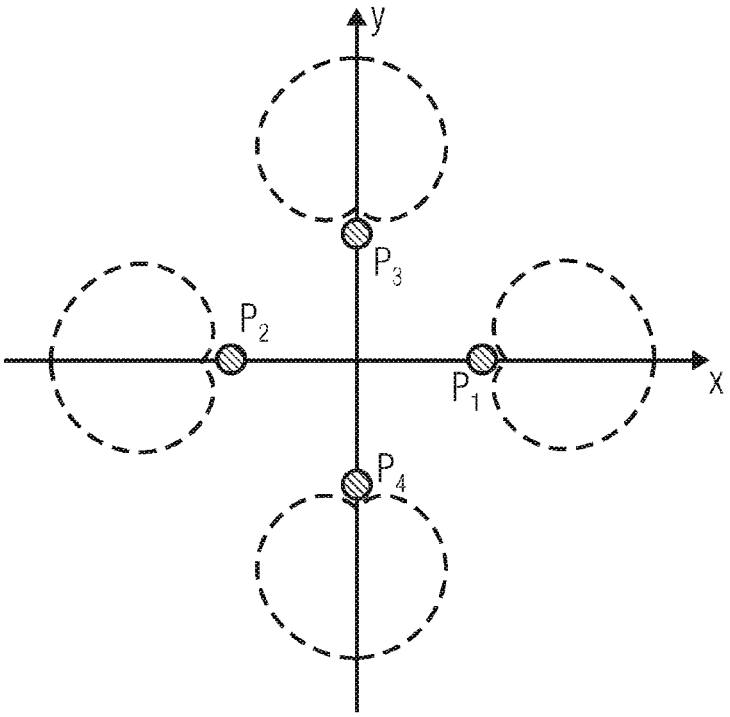
FIG. 3 shows an illustration of a microphone configuration using four directional microphones with cardioid pick up patterns.

In some applications, when only 2D analysis is needed, four directional microphones, e.g., arranged as in FIG. 3, can be employed. In this case, the direction information items may be chosen as:

$$b_1=[1\ 0\ 0]^T \tag{9}$$

$$b_2=[-1\ 0\ 0]^T \tag{10}$$

$$b_4=[0\ 1\ 0]^T \tag{11}$$

$$b_4=[0\ -1\ 0]^T \tag{12}$$

so that (7) becomes $$d_x=|P_1(k,n)|^\kappa \ldots |P_2(k,n)|^\kappa \tag{13}$$

$$d_y=|P_3(k,n)|^\kappa \ldots |P_4(k,n)|^\kappa \tag{14}$$

Figure 4:
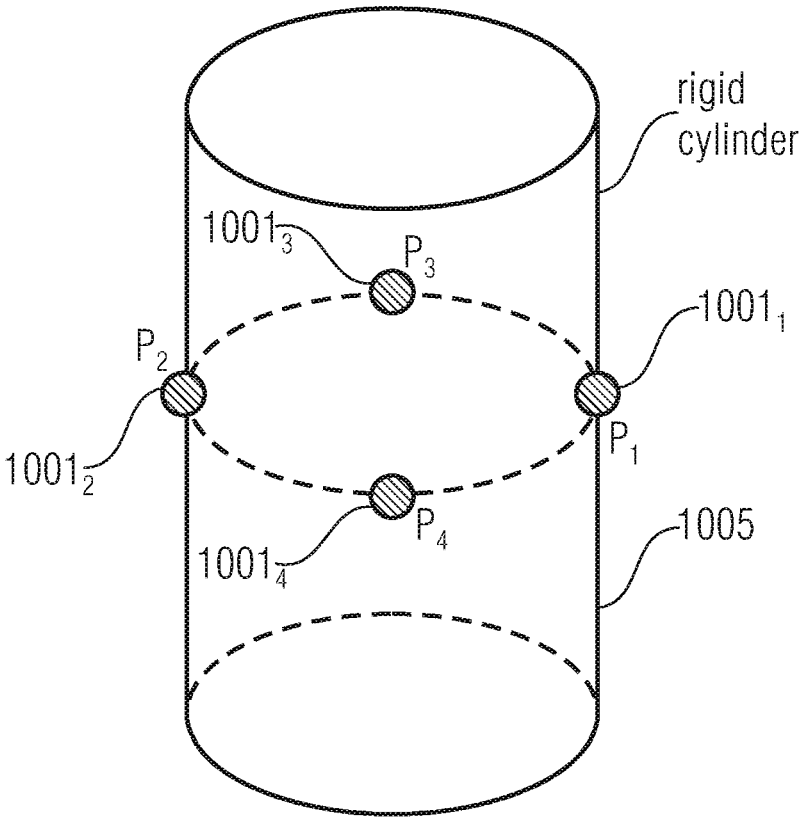
FIG. 4 shows an illustration of a microphone configuration employing a rigid cylinder to cause scattering and shadowing effects.
Figure 5:
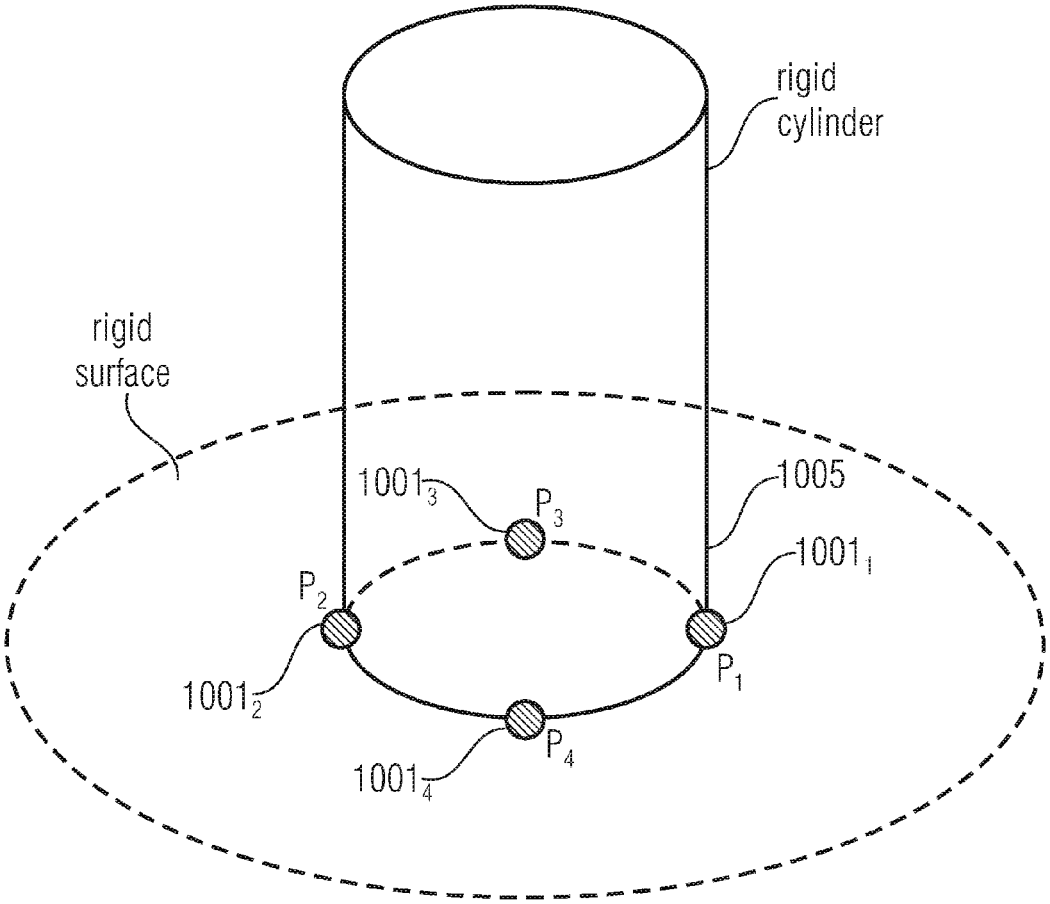
FIG. 5 shows an illustration of a microphone configuration similar to FIG. 4, but employing a different microphone placement.
Figure 6:
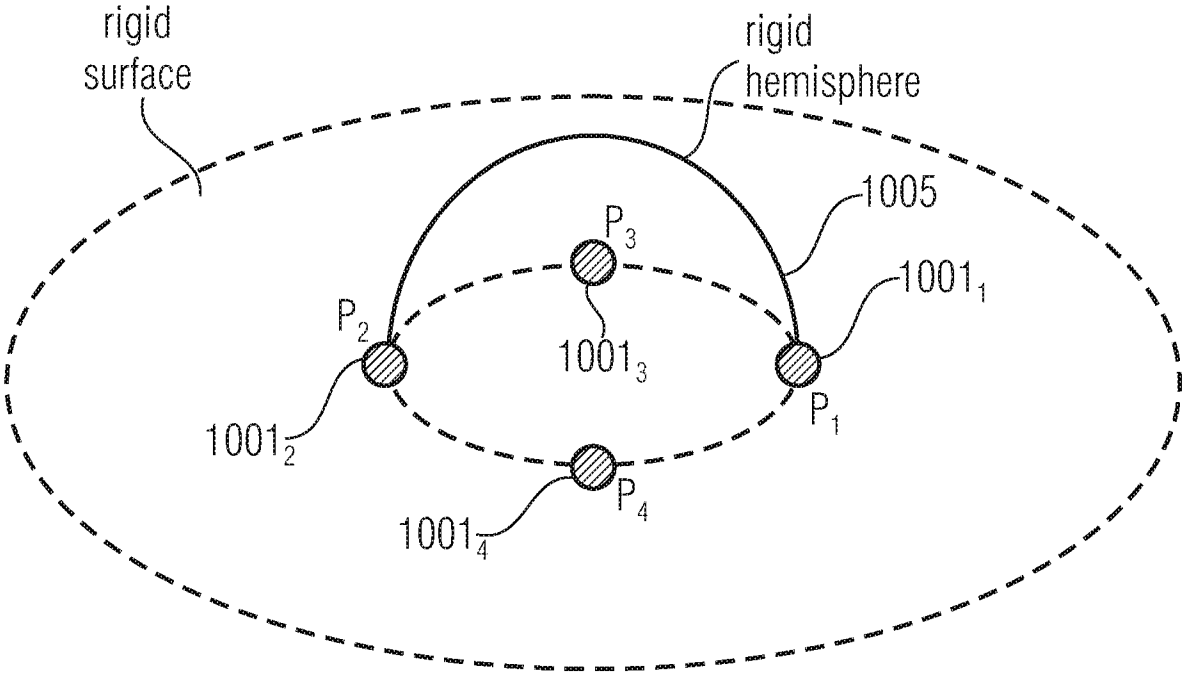
FIG. 6 shows an illustration of a microphone configuration employing a rigid hemisphere to cause scattering and shadowing effects.

This approach can analogously be applied in case of rigid objects placed in the microphone configuration. As an example, FIGS. 4 and 5, illustrate the case of a cylindrical object placed in the middle of an array of four microphones. Another example is shown in FIG. 6, where the scattering object has the shape of a hemisphere.

Figure 7:
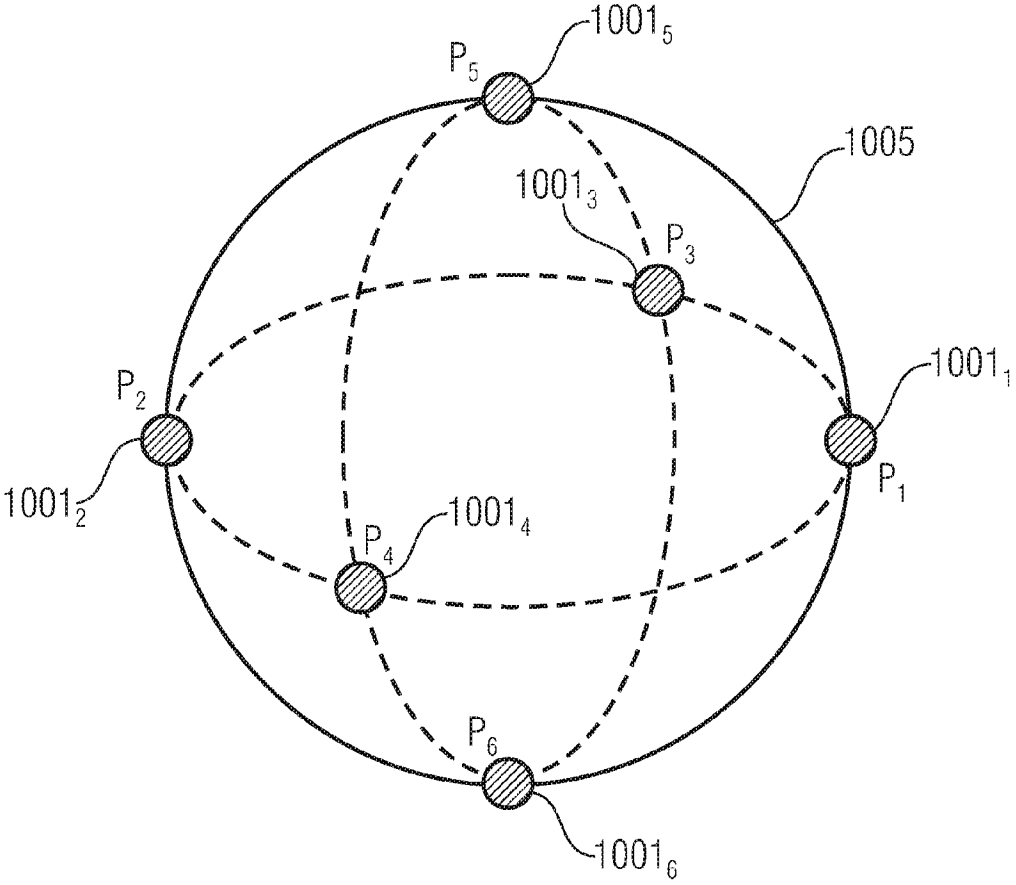
FIG. 7 shows an illustration of a 3D microphone configuration employing a rigid sphere to cause shadowing effects.

An example of a 3D configuration is shown in FIG. 7, where six microphones are distributed over a rigid sphere. In this case, the z component of the vector d(k, n) can be obtained analogously to (9)-(14):

$$b_5=[0\ 0\ 1]^T \tag{15}$$

$$b_6=[0\ 0\ -1]^T \tag{16}$$

yielding $$d_z=|P_5(k,n)|^\kappa-|P_6(k,n)|^\kappa. \tag{17}$$

A well known 3D configuration of directional microphones which is suitable for application in embodiments of this invention is the so-called A-format microphone, as described in P. G. Craven and M. A. Gerzon, U.S. Pat. No. 4,042,779 (A), 1977.

To follow the proposed directional magnitude combination approach, certain assumptions need to be fulfilled. If directional microphones are employed, then for each microphone the pick up patterns should be approximately symmetric with respect to the orientation or look direction of the microphones. If the scattering/shadowing approach is used, then scattering/shadowing effects should be approximately symmetric with respect to the direction of maximum response. These assumptions are easily met when the array is constructed as in the examples shown in FIGS. 3 to 7.

Application in DirAC

The above discussion considers the estimation of the directional information (the DOA) only. In the context of directional coding information about the diffuseness of a sound field may additionally be needed. A straightforward approach is obtained by simply equating the estimated vector d(k, n) or determined directional information with the opposite direction of the active sound intensity vector $I_a(k, n)$:

$$I_a(k,n)=-d(k,n). \tag{18}$$

This is possible as d(k, n) contains information related to the energetic gradient. Then, the diffuseness can be computed according to (3).

5.2. Method According to FIG. 8

Further embodiments of the present invention create a method for deriving a directional information from a plurality of microphone signals or from a plurality of components of a microphone signal, wherein different effective microphone look directions are associated with the microphone signals.

Figure 8:
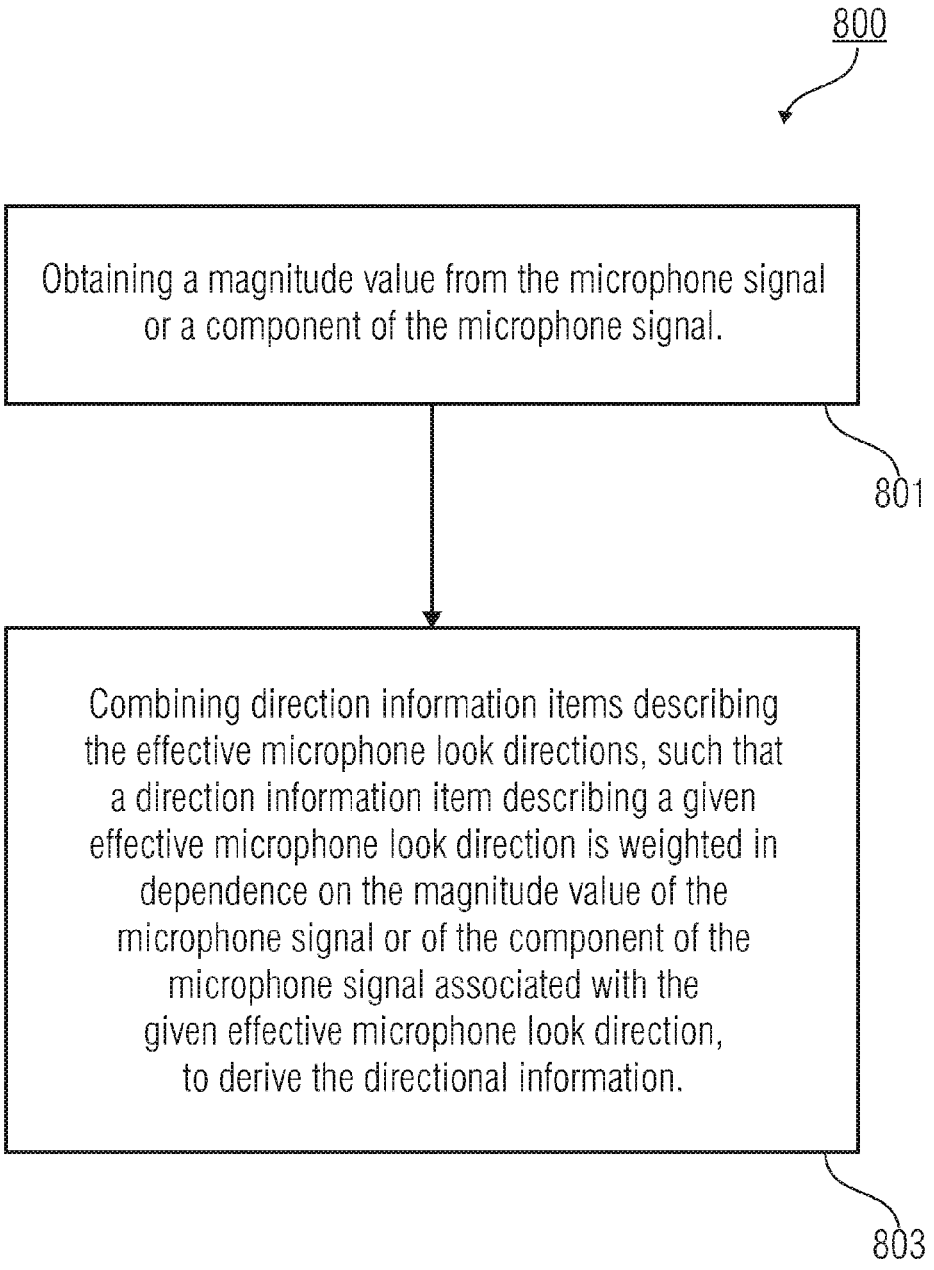
FIG. 8 shows a flow diagram of a method according to an embodiment.

Such a method 800 is shown in a flow diagram in FIG. 8. The method 800 comprises a step 801 of obtaining a magnitude from a microphone signal or a component of the microphone signal.

Furthermore, the method 800 comprises a step 803 of combining (e.g. linearly combining) direction information items describing the effective microphone look directions, such that a direction information item describing a given effective microphone look direction is weighted in dependence on the magnitude value of the microphone signal or of the component of the microphone signal associated with the corresponding effective microphone look direction, to derive the directional information.

The method 800 may be performed by the apparatus 100 (for example by the combiner 105 of the apparatus 100).

In the following, two systems according to embodiments may be described for acquiring the microphone signals and deriving a directional information from these microphone signals using FIGS. 9 and 10.

Figure 9:
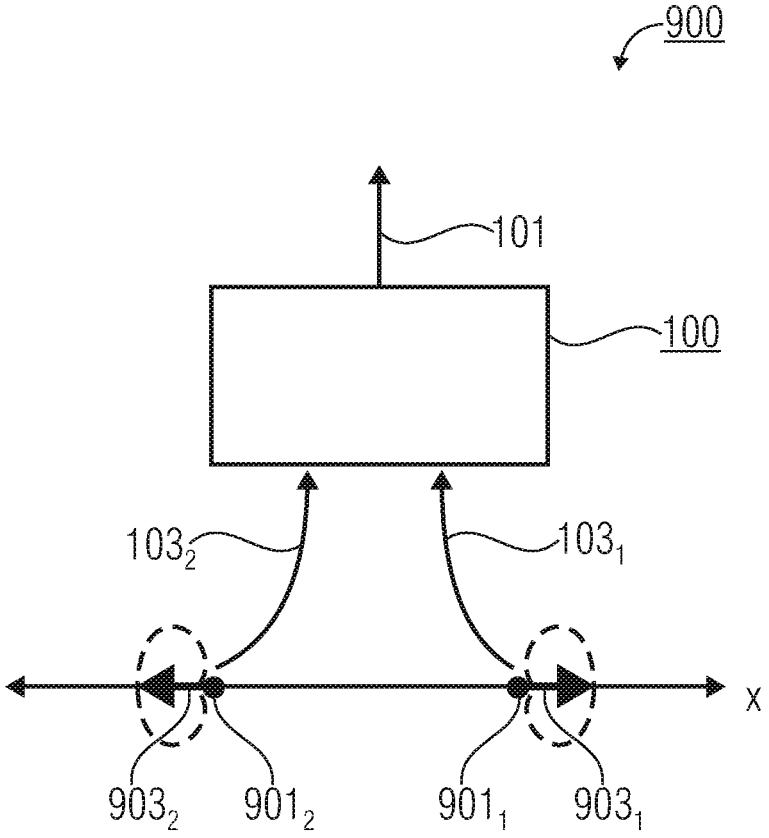
FIG. 9 shows a block schematic diagram of a system according to an embodiment.
Figure 10:
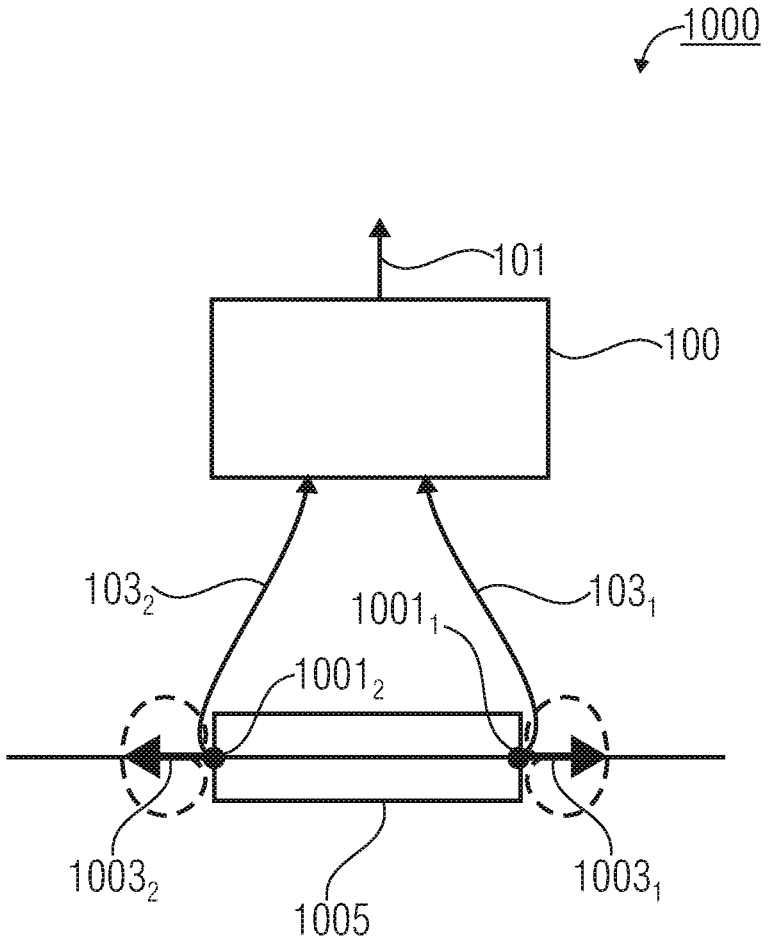
FIG. 10 shows a block schematic diagram of a system according to a further embodiment of the present invention.

5.3 Systems According to FIG. 9 and FIG. 10

As commonly known, the use of the pressure magnitude to extract directional information is not practical when using omnidirectional microphones. In fact, the magnitude differences due to the different distances traveled by the sound to reach the microphones is normally too small to be measured, so that most known algorithms mainly rely on the phase information. Embodiments overcome the problem of spatial aliasing in directional parameter estimation. The systems described in the following make use of microphone arrays adequately designed so that there exists a measurable magnitude difference in the microphone signals which is dependent on the direction of arrival. (Only) This magnitude information of the microphone spectra is then used in the estimation process, as the phase term is corrupted by the spatial aliasing effect.

Embodiments comprise extracting directional information (such as DOA or diffuseness) of a sound field analyzed in a time-frequency domain from only the magnitudes of the spectra of two or more microphones, or of one microphone subsequently placed in two or more positions, e.g., by making one microphone rotate about an axis. This is possible when the magnitudes vary sufficiently strong in a predictable way depending on the direction of arrival. This can be achieved in two ways, namely by 1. employing directional microphones (i.e., possessing a non isotropic pick up pattern such as cardioid microphones), where each microphone points to a different direction, or by
2. realizing for each microphone or microphone position a unique scattering and/or shadowing effect. This can be achieved for instance by employing a physical object in the center of the microphone configuration. Suitable objects modify the magnitudes of the microphone signals in a known way by means of scattering and/or shadowing effects.

An example for a system using the first method is shown in FIG. 9.

5.3.1 System Using Directional Microphones According to FIG. 9

FIG. 9 shows a block schematic diagram of a system 900, the system comprises an apparatus, for example the apparatus 100 according to FIG. 1. Furthermore, the system 900 comprises a first directional microphone $\mathbf{901}_1$ having a first effective microphone look direction $\mathbf{903}_1$ for deriving a first microphone signal $\mathbf{103}_1$ of the plurality of microphone signals of the apparatus 100. The first microphone signal $\mathbf{103}_1$ is associated with the first look direction $\mathbf{903}_1$. Furthermore, the system 900 comprises a second directional microphone $\mathbf{901}_2$ having a second effective microphone look direction $\mathbf{903}_2$ for deriving a second microphone signal $\mathbf{103}_2$ of the plurality of microphone signals of the apparatus 100. The second microphone signal $\mathbf{103}_2$ is associated with the second look direction $\mathbf{903}_2$. Furthermore, the first look direction $\mathbf{903}_1$ is different from the second look direction $\mathbf{903}_2$. For example, the look directions $\mathbf{903}_1$, $\mathbf{903}_2$ may be opposing. A further extension to this concept is shown in FIG. 3, where four cardioid microphones (directional microphones) are pointed towards opposing directions of a Cartesian coordinate system. The microphone positions are marked by black circuits.

By applying directional microphones it can be achieved that magnitude differences between the directional microphones $\mathbf{901}_1$, $\mathbf{901}_2$ are large enough to determine the directional information 101.

An example of a system using the second method to achieve a strong variation of magnitudes of different microphone signals for omnidirectional microphones is shown in FIG. 10.

5.3.2 System Using Omnidirectional Microphones According to FIG. 10

FIG. 10 shows a system 1000 comprising an apparatus, for example, the apparatus 100 according to FIG. 1, for deriving a directional information 101 from a plurality of microphone signals or components of a microphone signal. Furthermore, the system 1000 comprises a first omnidirectional microphone $\mathbf{1001}_1$ for deriving a first microphone signal $\mathbf{103}_1$ of the plurality of microphone signals of the apparatus 100. Furthermore, the system 1000 comprises a second omnidirectional microphone $\mathbf{1001}_2$ for deriving a second microphone signal $\mathbf{103}_2$ of the plurality of microphone signals of the apparatus 100. Furthermore, the system 1000 comprises a shadowing object 1005 (also denoted as scattering object 1005) placed between the first omnidirectional microphone $\mathbf{1001}_1$ and the second omnidirectional microphone $\mathbf{1001}_2$ for shaping effective response patterns of the first omnidirectional microphone $\mathbf{1001}_1$ and of the second omnidirectional microphone $\mathbf{1001}_2$, such that a shaped effective response pattern of the first omnidirectional microphone $\mathbf{1001}_1$ comprises a first effective microphone look direction $\mathbf{1003}_1$ and a shaped effected pattern of the second omnidirectional microphone $\mathbf{1001}_2$ comprises a second effective microphone look direction $\mathbf{1003}_2$. In other words, by using the shadowing object 1005 between the omnidirectional microphones $\mathbf{1001}_1$, $\mathbf{1001}_2$ a directional behavior of the omnidirectional microphones $\mathbf{1001}_1$, $\mathbf{1001}_2$ can be achieved such that measurable magnitude differences between the omnidirectional microphones $\mathbf{1001}_1$, $\mathbf{1001}_2$ even with a small distance between the two omnidirectional microphones $\mathbf{1001}_1$, $\mathbf{1001}_2$ can be achieved.

Further optional extensions to the system 1000 are given in FIG. 4 to FIG. 6, in which different geometric objects are placed in the middle of a conventional array of four (omnidirectional) microphones.

FIG. 4 shows an illustration of a microphone configuration employing an object 1005 to cause scattering and shadowing effects. In this example in FIG. 4 the object is a rigid cylinder. The microphone positions of four (omnidirectional) microphones $\mathbf{1001}_1$ to $\mathbf{1001}_4$ are marked by the black circuits.

FIG. 5 shows an illustration of a microphone configuration similar to FIG. 4, but employing a different microphone placement (on a rigid surface of a rigid cylinder). The microphone positions of the four (omnidirectional) microphones $\mathbf{1001}_1$ to $\mathbf{1001}_4$ are marked by the black circuits. In the example shown in FIG. 5 the shadowing object 1005 comprises the rigid cylinder and the rigid surface.

FIG. 6 shows an illustration of a microphone configuration employing a further object 1005 to cause scattering and shadowing effects. In this example, the object 1005 is a rigid hemisphere (with a rigid surface). The microphone positions of the four (omnidirectional) microphones $\mathbf{1001}_1$ to $\mathbf{1001}_4$ are marked by the black circuits.

Furthermore, FIG. 7 shows an example for a three-dimensional DOA estimation (a three-dimensional directional information derivation) using six (omnidirectional) microphones $\mathbf{1001}_1$ to $\mathbf{1001}_6$ distributed over a rigid sphere. In other words, FIG. 6 shows an illustration of a 3D microphone configuration employing an object 1005 to cause shadowing effects. In this example, the object is a rigid sphere. The microphone positions of the (omnidirectional) microphones $\mathbf{1001}_1$ to $\mathbf{1001}_6$ are marked by the black circuits.

From the magnitude differences between the different microphone signals generated by the different microphones shown in FIGS. 2 to 7 and 9 to 10, embodiments compute the directional information following the approach explained in conjunction with the apparatus 100 according to FIG. 1.

According to further embodiments, the first directional microphone $\mathbf{901}_1$ or the first omnidirectional microphone $\mathbf{1001}_1$ and the second directional microphone $\mathbf{901}_2$ or the second omnidirectional microphone $\mathbf{1001}_2$ may be arranged such that a sum of a first direction information item being a vector pointing in the first effective microphone look direction $\mathbf{903}_1$, $\mathbf{1003}_1$ and of a second direction information item being a vector pointing into the second effective microphone look direction $\mathbf{903}_2$, $\mathbf{1003}_2$ equals 0 within a tolerance range of +/−5%, +/−10%, +/−20% or +/−30% of the first direction information item or the second direction information item.

In other words, equation (6) may apply to the microphones of the systems 900, 1000, in which $b_i$ is a direction information item of the i-th microphone being a unit vector pointing in the effective microphone look direction of the i-th microphone.

In the following, alternative solutions for using the magnitude information of the microphone signals for directional parameter estimation will be described.

5.4 Alternate Solutions 5.4.1 Correlation Based Approach

An alternative approach to exploit solely the magnitude information of microphone signals for directional parameter estimation is proposed in this section. It is based on correlations between magnitude spectra of the microphone signals and corresponding a priori determined magnitude spectra obtained from models or measurements.

Let $S_i(k, n)=|P_i(k, n)|^{\kappa}$ denote the magnitude or power spectrum of the i-th microphone signal. Then, we define the measured magnitude array response S(k, n) of the N microphones as $$S(k,n)=[S_1(k,n),S_2(k,n), \ldots ,S_N(k,n))]^T. \tag{19}$$

The corresponding magnitude array manifold of the microphone array is denoted by $S_{\mathcal{M}}(\phi, k, n)$. The magnitude array manifold obviously depends on the DOA of sound $\phi$ if directional microphones with different look direction or scattering/shadowing with objects within the array are used. The influence on the DOA of sound on the array manifold depends on the actual array configuration, and it is influenced by the directional patterns of the microphones and/or scattering object included in the microphone configuration. The array manifold can be determined from measurements of the array, where sound is played back from different directions. Alternatively, physical models can be applied. The effect of a cylindrical scatterer on the sound pressure distribution on its surface is, e.g., described in H. Teutsch and W. Kellermann, Acoustic source detection and localization based on wavefield decomposition using circular microphone arrays, J. Acoust. Soc. Am., 5(120), 2006.

To determine the desired estimate of the DOA of sound, the magnitude array response and the magnitude array manifold are correlated. The estimated DOA corresponds to the maximum of the normalized correlation according to $$\varphi = \underset{\varphi}{\operatorname{argmax}}\left\{\frac{S^T(k,n)S_M(\varphi,k,n)}{\|S(k,n)\|\|S_M(\varphi,k,n)\|}\right\}. \tag{20}$$

Although we have presented only the 2D case for the DOA estimation here, it is obvious that the 3D DOA estimation including azimuth and elevation can be performed analogously.

5.4.2 Noise Subspace Based Approach

An alternative approach to exploit solely the magnitude information of microphone signals for directional parameter estimation is proposed in this section. It is based on the well known root MUSIC algorithm (R. Schmidt, Multiple emitter location and signal parameter estimation, IEEE Transactions on Antennas and Propagation, 34(3):276-280, 1986), with the exception that in the example shown only the magnitude information is processed.

Let S(k, n) be the measured magnitude array response, as defined in (19). In the following the dependencies on k and n are omitted, as all steps are carried out separately for each time frequency bin. The correlation matrix R can be computed with $$R=E\{SS^H\}, \tag{21}$$

where (•)H denotes the conjugate transpose and E{•} is the expectation operator. The expectation is usually approximated by a temporal and/or spectral averaging process in the practical application. The eigenvalue decomposition of R can be written as $$R = [Q_s, Q_n]\begin{pmatrix} \lambda_1 & 0 & \cdots \\ 0 & \lambda_2 & 0 \\ \vdots & 0 & \ddots \end{pmatrix}[Q_s, Q_n]^H, \tag{22}$$

where $X_{1 \ldots N}$ are the eigenvalues and N is the number of microphones or measurement positions. Now, when a strong plane wave arrives at the microphone array, one relatively large eigenvalue $\lambda$ is obtained, while all other eigenvalues are close to zero. The eigenvectors, which correspond to the latter eigenvalues, form the so-called noise subspace $Q_n$. This matrix is orthogonal to the so-called signal subspace $Q_s$, which contains the eigenvector(s) corresponding to the largest eigenvalue(s). The so-called MUSIC spectrum can be computed with $$P(\varphi) = \frac{1}{s(\varphi)^H Q_n Q_n^H s(\varphi)}, \tag{23}$$

where the steering vector $s(\phi)$ for the investigated steering direction $\phi$ is taken from the array manifold $S_{\mathcal{M}}$ introduced in the previous section. The MUSIC spectrum $P(\phi)$ becomes maximum when the steering direction $\phi$ matches the true DOA of the sound. Thus, the DOA of the sound $\phi_{DOA}$ can be determined by taking the $\phi$ for which $P(\phi)$ becomes maximum, i.e., $$\varphi_{DOA} = \underset{\varphi}{\operatorname{argmax}} P(\varphi). \tag{24}$$

In the following, an example of a detailed embodiment of the present invention for a broadband direction estimation method/apparatus utilizing combined pressure and energy gradients from an optimized microphone array will be described.

5.5 Example of a Direction Estimation Utilizing Combined Pressure and Energy Gradients 5.5.1 Introduction The analysis of the arrival direction of sound is used in several audio reproduction techniques to provide the parametric representation of spatial sound from multichannel audio file or from multiple microphone signals (F. Baumgarte and C. Faller, "Binaural Cue Coding—part I: Psychoacoustic fundamentals and design principles," IEEE Trans. Speech Audio Process., vol. 11, pp. 509-519, November 2003; M. Goodwin and J-M. Jot, "Analysis and synthesis for Universal Spatial Audio Coding," in Proc. AES 121st Convention, San Francisco, Calif., USA, 2006; V. Pulkki, "Spatial sound reproduction with Directional Audio Coding," J. Audio Eng. Soc, vol. 55, pp. 503-516, June 2007; and C. Faller, "Microphone front-ends for spatial audio coders," in Proc. AES 125th Convention, San Francisco, Calif., USA, 2008). Besides the spatial sound reproduction, the analyzed direction can also be utilized in such applications as source localization and beamforming (M. Kallinger, G. Del Galdo, F. Kuech, D. Mahne, and R. Schultz-Amling, "Spatial filtering using Directional Audio Coding parameters," in Proc. IEEE International Conference on Acoustics, Speech and Signal Processing. IEEE Computer Society, pp. 217-220, 2009 and O. Thiergart, R. Schultz-Amling, G. Del Galdo, D. Mahne, and F. Kuech, "Localization of sound sources in reverberant environments based on Directional Audio Coding parameters," inn Proc. AES 127th Convention, New York, N.Y., USA, 2009). In this example, the analysis of direction is discussed in a point of view of a processing technique, Directional Audio Coding (DirAC), for recording and reproduction the spatial sound in various applications (V. Pulkki, "Spatial sound reproduction with Directional Audio Coding," J. Audio Eng. Soc, vol. 55, pp. 503-516, June 2007).

Generally, the analysis of direction in DirAC is based on the measurement of the 3D sound intensity vector, needing information about sound pressure and particle velocity in a single point of sound field. DirAC is thus used with the B-format signals in a form of an omnidirectional signal and three dipole signals directed along the Cartesian coordinates. The B-format signals can be derived from an array of closely-spaced or coincident microphones (J. Merimaa, "Applications of a 3-D microphone array," in Proc. AES 112th Convention, Munich, Germany, 2002 and M. A. Gerzon, "The design of precisely coincident microphone arrays for stereo and surround sound," in Proc. AES 50th Convention, 1975). A consumer-level solution with four omnidirectional microphones placed in a square array is used here. Unfortunately, the dipole signals, which are derived as pressure gradients from such an array, suffer from spatial aliasing at high frequencies. Consequently, the direction is estimated erroneously above the spatial-aliasing frequency, which can be derived from the spacing of the array.

In this example, a method to extend the reliable direction estimation above the spatial-aliasing frequency is presented with real omnidirectional microphones. The method utilizes the fact that a microphone itself shadows the arriving sound with relatively short wavelengths at high frequencies. Such a shadowing produces measurable inter-microphone level differences for the microphones placed in the array, depending on the arrival direction. This makes it possible to approximate the sound intensity vector by computing a energy gradient between the microphone signals, and moreover to estimate the arrival direction based on this. Additionally, the size of the microphone determines the frequency-limit, above which the level differences are sufficient for using the energy gradients feasibly. The shadowing comes into effect at lower frequencies with a larger size. The example also discusses how to optimize a spacing in the array, depending on the diaphragm size of the microphone, to match the estimation methods using both the pressure and energy gradients.

The example is organized as follows. Section 5.5.2 reviews the direction estimation using the energetic analysis with the B-format signals, whose creation with a square array of omnidirectional microphones is described in Section 5.5.3. In Section 5.5.4, the method to estimate direction using the energy gradients is presented with relatively large-size microphones in the square array. Section 5.5.5 proposes a method to optimize a microphone spacing in the array. The evaluations of the methods are presented in Section 5.5.6. Finally, conclusions are given in Section 5.5.7.

5.5.2 Direction Estimation in Energetic Analysis

The estimation of direction with the energetic analysis is based on the sound intensity vector, which represents the direction and magnitude of the net flow of sound energy. For the analysis, the sound pressure p and the particle velocity u can be estimated in one point of sound field using the omnidirectional signal W and the dipole signals (X, Y and Z for the Cartesian directions) of B-format, respectively. To harmonize the sound field, the time-frequency analysis, as short-time Fourier transform (STFT) with a 20 ms time-window, is applied to the B-format signals in the DirAC implementation presented here. Subsequently, the instantaneous active sound intensity $$I(t, f) = \frac{1}{\sqrt{2}\,Z_0}\mathrm{Re}\{W^*(t, f)\cdot X(t, f)\} \qquad ((25)$$

is computed at each time-frequency tile from the STFT-transformed B-format signals for which the dipoles are expressed as $X(t, f)=[X(t, f)\ Y(t, f)\ Z(t, f)]^T$. Here, t and f are time and frequency, respectively, and $Z_0$ is the acoustic impedance of the air. Besides, $Z_0=\rho_0 c$, where $\rho_0$ is the mean density of the air, and c is the speed of sound. The direction of the arrival of sound, as azimuth θ and elevation ϕ angles, is defined as the opposite to the direction of the sound intensity vector.

5.5.3 Microphone Array to Derive B-Format Signals in Horizontal Plane

Figure 11:
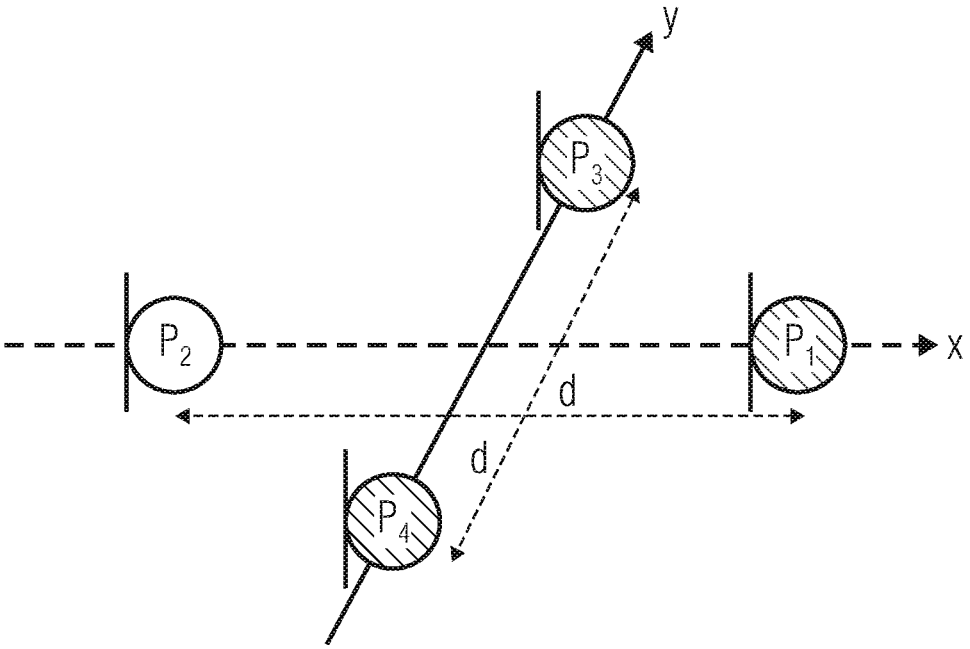
FIG. 11 shows an illustration of an array of four omnidirectional microphones with spacing of d between the opposing microphones.

FIG. 11 shows an array of four omnidirectional microphones with spacing of d between opposing microphones.

An array, which is composed of four closely-spaced omnidirectional microphones and shown in FIG. 11, has been used to derive the horizontal B-format signals (W, X and Y) for estimating the azimuth angle θ of the direction in DirAC (M. Kallinger, G. Del Galdo, F. Kuech, D. Mahne, and R. Schultz-Amling, "Spatial filtering using Directional Audio Coding parameters," in Proc. IEEE International Conference on Acoustics, Speech and Signal Processing. IEEE Computer Society, pp. 217-220, 2009 and O. Thiergart, R. Schultz-Amling, G. Del Galdo, D. Mahne, and F. Kuech, "Localization of sound sources in reverberant environments based on Directional Audio Coding parameters," inn Proc. AES 127th Convention, New York, N.Y., USA, 2009). The microphones of relatively small sizes are typically positioned a few centimeters (e.g., 2 cm) apart from one another. With such an array, the omnidirectional signal W can be produced as an average over the microphone signals, and the dipole signals X and Y are derived as pressure gradients by subtracting the signals of the opposing microphones from one another as $$X(t,f)=\sqrt{2}\cdot A(f)\cdot[P_1(t,f)-P_2(t,f)]$$

$$Y(t,f)=\sqrt{2}\cdot A(f)\cdot[P_3(t,f)-P_4(t,f)] \quad (26)$$

Here, $P_1$, $P_2$, $P_3$ and $P_4$ are the STFT-transformed microphone signals, and A(f) is a frequency-dependent equalization constant. Moreover, $A(f)=-j(cN)/(2\pi f d f_s)$, where j is the imaginary unit, N is the number of the frequency bins or tiles of STFT, d is the distance between the opposing microphones, and $f_s$ is the sampling rate.

As already mentioned, the spatial aliasing comes into effect in the pressure gradients and starts to distort the dipole signals, when the half-wavelength of the arrival sound is smaller than the distance between the opposing microphones. The theoretical spatial-aliasing frequency $f_{sa}$ to define the upper-frequency limit for a valid dipole signal is thus computed as $$f_{sa}=\frac{c}{2d}, \quad (27)$$

above which the direction is estimated erroneously.

5.5.4 Direction Estimation Using Energy Gradients

Figure 12:
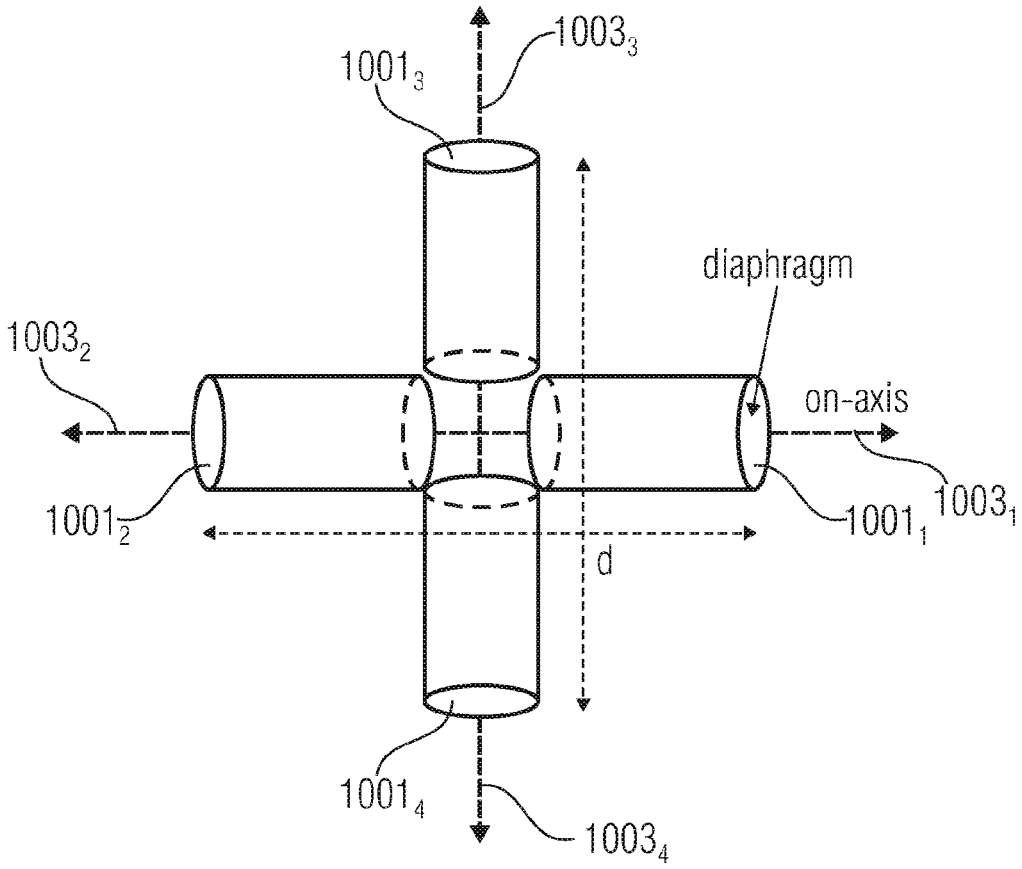
FIG. 12 shows an illustration of an array of four omnidirectional microphones, which are mounted on the end of a cylinder.

Since the spatial aliasing and the directivity of the microphone by the shadowing inhibit the use of the pressure gradients at high frequencies, a method to extend frequency range for the reliable direction estimation is desired. Here, an array of four omnidirectional microphones, arranged such that their on-axis directions point outward and opposing directions, is employed in a proposed method for broadband direction estimation. FIG. 12 shows such an array, in which different amount of the sound energy from the plane wave is captured with different microphones.

The four omnidirectional microphones $\mathbf{1001}_1$ to $\mathbf{1001}_4$ of the array shown in FIG. 12 are mounted on the end of a cylinder. On-axis directions $\mathbf{1003}_1$ to $\mathbf{1003}_4$ of the microphones point outwards from the center of the array. Such an array is used to estimate an arrival direction of a sound wave using energy gradients.

The energy differences are assumed here to make it possible to estimate 2D sound intensity vector, when the x- and y-axial components of it are approximated by subtracting the power spectrums of the opposing microphones as $$\tilde{I}_x(t,f)=|P_1(t,f)|^2-|P_2(t,f)|^2$$

$$\tilde{I}_y(t,f)=|P_3(t,f)|^2-|P_4(t,f)|^2. \quad (28)$$

The azimuth angle θ for the arriving plane wave can further be obtained from the intensity approximations $\tilde{I}_x$ and $\tilde{I}_y$. To make the above described computation feasible, the inter-microphone level differences large enough to be measured with an acceptable signal-to-noise ratio are desired. Hence, the microphones having relatively large diaphragms are employed in the array.

In Some cases, the energy gradients cannot be used to estimate direction at lower frequencies, where the microphones do not shadow the arriving sound wave with relatively long wavelengths. Hence, the information of the direction of sound at high frequencies may be combined with the information of the direction at low frequencies obtained with pressure gradients. The crossover frequency between the techniques in clearly is the spatial-aliasing frequency $f_{sa}$ according to Eq. (27).

5.5.5 Spacing Optimization of Microphone Array

As stated earlier, the size of the diaphragm determines frequencies at which the shadowing by the microphone is effective for computing the energy gradients. To match the spatial-aliasing frequency $f_{sa}$ with the frequency-limit $f_{lim}$ for using the energy gradients, microphones should be positioned a proper distance from one another in the array. Hence, defining the spacing between the microphones with a certain size of the diaphragm is discussed in this section.

The frequency-dependent directivity index for an omnidirectional microphone can be measured in decibels as $$DI(f)=10\log_{10}(\Delta L(f)), \quad (29)$$

where ΔL is the ratio of on-axis pickup energy related to the total pickup energy integrated over all directions (J. Eargle, "The microphone book," Focal Press, Boston, USA, 2001). Furthermore, the directivity index at each frequency depends on a ratio value $$ka=\frac{2\pi r}{\lambda} \quad (30)$$

between the diaphragm circumference and wavelength. Here, r is the radius of the diaphragm and λ is the wavelength. Moreover, $\lambda=c/f_{lim}$. The dependence of the directivity index DI as a function of the ratio value ka has been shown by simulation in J. Eargle, "The microphone book," Focal Press, Boston, USA, 2001 to be a monotonically increasing function, as shown in FIG. 13.

Figure 13:
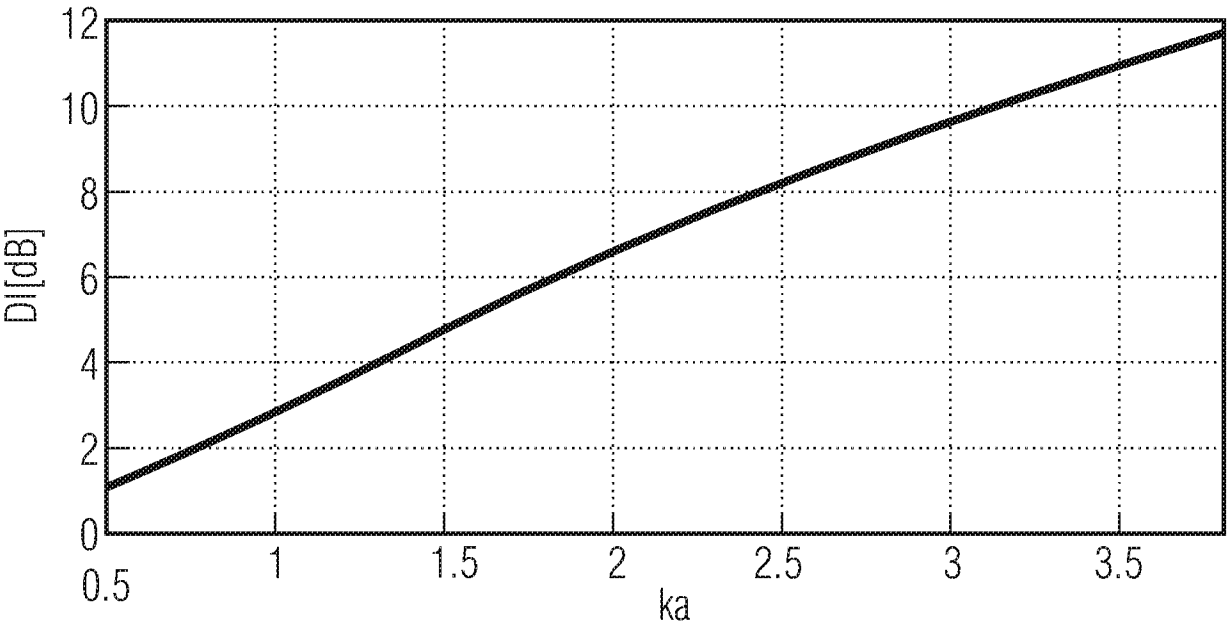
FIG. 13 shows a diagram of a directivity index DI in decibels as a function of ka, which represents a diaphragm circumference of an omnidirectional microphone divided by the wavelength.

The directivity index DI in decibels shown in FIG. 13 is adapted from J. Eargle, "The microphone book," Focal Press, Boston, USA, 2001. Theoretical indexes are plotted as a function of ka, which represents the diaphragm circumference of the omnidirectional microphone divided by wavelength.

Such a dependence is used here to define the ratio value ka for a desired directivity index DI. In this example, DI is defined to be 2.8 dB producing ka value of 1. The optimized microphone spacing with a given directivity index can now be defined by employing Eq. (27) and Eq. (30), when the spatial aliasing frequency $f_{sa}$ equals with the frequency-limit $f_{lim}$. The optimized spacing is thus computed as $$d_{opt}=\frac{\pi r}{ka}. \quad (31)$$

5.5.6 Evaluation of Direction Estimations

The direction estimation methods discussed in this example are now evaluated in DirAC analysis with anechoic measurements and simulations. Instead of measuring four microphones in a square at the same time, the impulse responses were measured from multiple directions with a single omnidirectional microphone with relatively large diaphragm. The measured responses were subsequently used to estimate the impulse responses of four omnidirectional microphones placed in a square, as shown in FIG. 12. Consequently, the energy gradients depended mainly on the diaphragm size of the microphone, and the spacing optimization can thus be studied as described in Section 5.5.5. Obviously, four microphones in the array would provide effectively more shadowing for the arriving sound wave, and the direction estimation would be improved some from the case of a single microphone. The above described evaluations are applied here with two different microphones having different diaphragm sizes.

The impulse responses were measured at intervals of 5° using a movable loudspeaker (Genelec 8030A) at the distance of 1.6 m in an anechoic chamber. The measurements at different angles were conducted using a swept sine at 20-20000 Hz and 1 s in length. The A-weighted sound pressure level was 75 dB. The measurements were conducted using G.R.A.S Type 40AI and AKG CK 62-ULS omnidirectional microphones with the diaphragms of 1.27 cm (0.5 inch) and 2.1 cm (0.8 inch) in diameters, respectively.

In the simulations, the directivity index DI was defined to be 2.8 dB, which corresponds to the ratio ka with a value of 1 in FIG. 13. According to the optimized microphone spacing in Eq. (31), the opposing microphones were simulated at distance of 2 cm and 3.3 cm apart from one another with G.R.A.S and AKG microphones, respectively. Such spacings result in the spatial-aliasing frequencies of 8575 Hz and 5197 Hz.

Figure 14A:
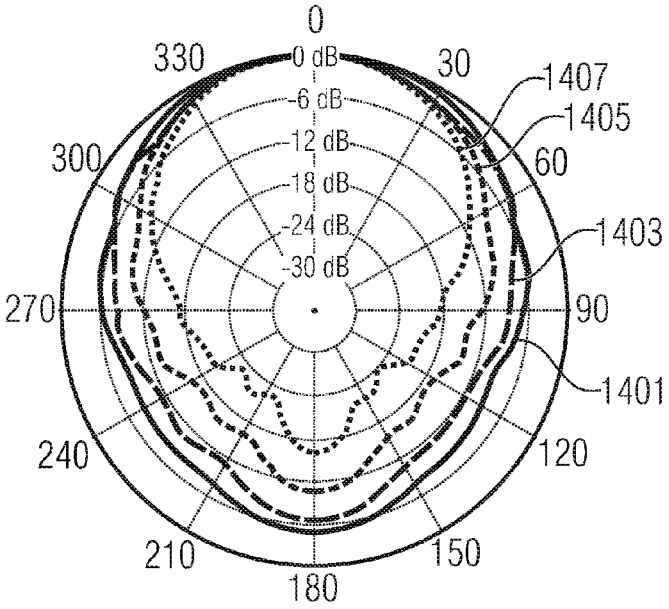
FIGS. 14A-14C show logarithmic directional patterns with G.R.A.S. microphone.
Figure 14B:
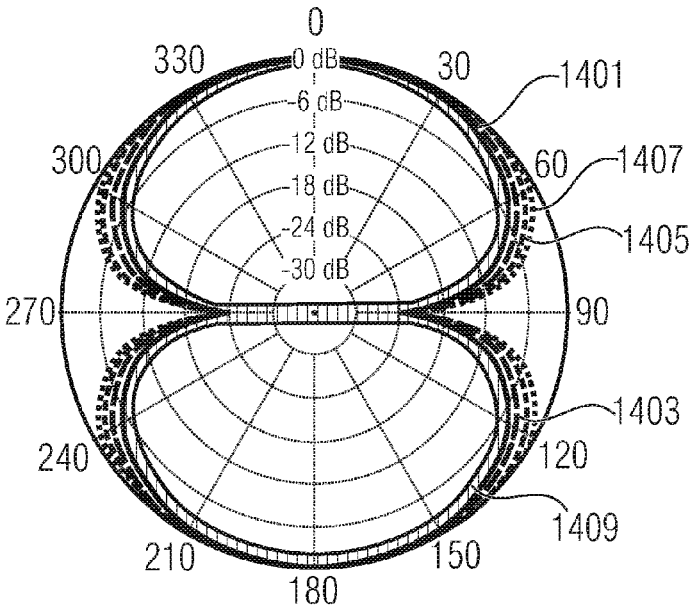
Figure 14C:
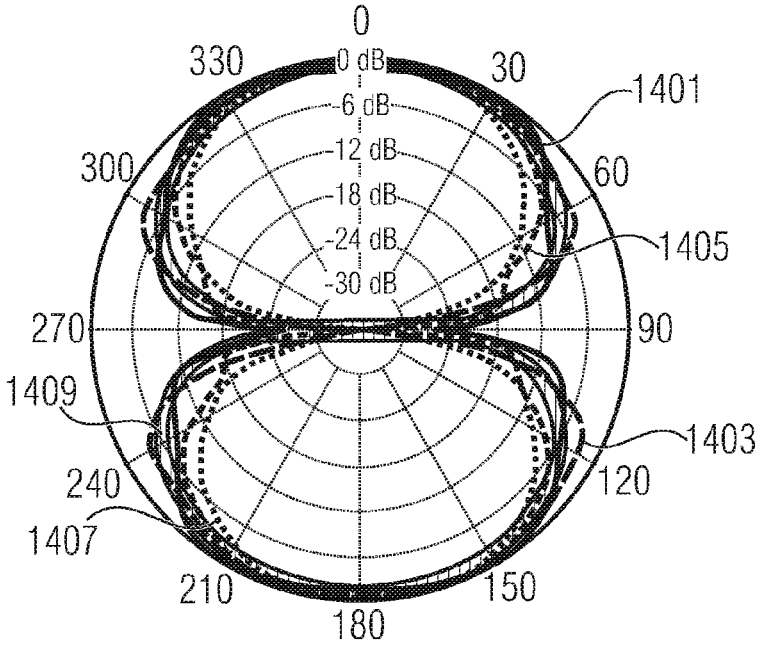
Figure 15A:
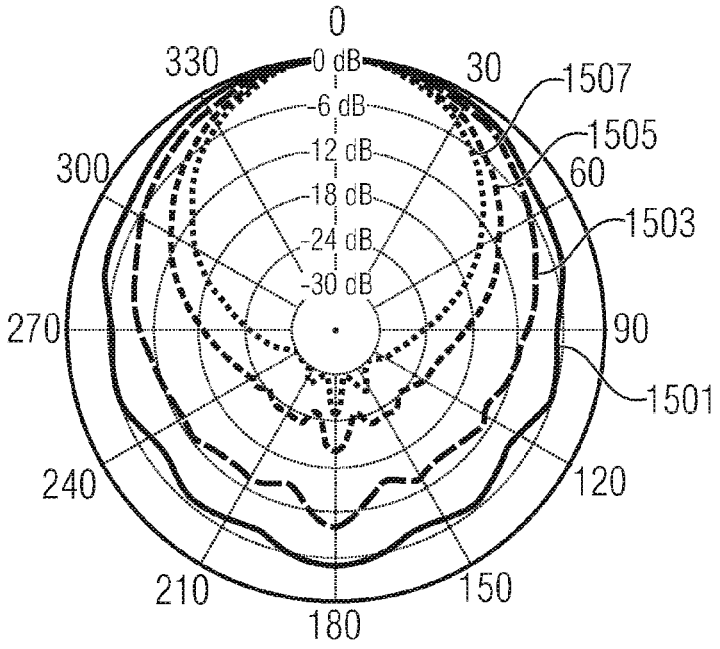
FIGS. 15A-15C show logarithmic directional patterns with AKG microphone.
Figure 15B:
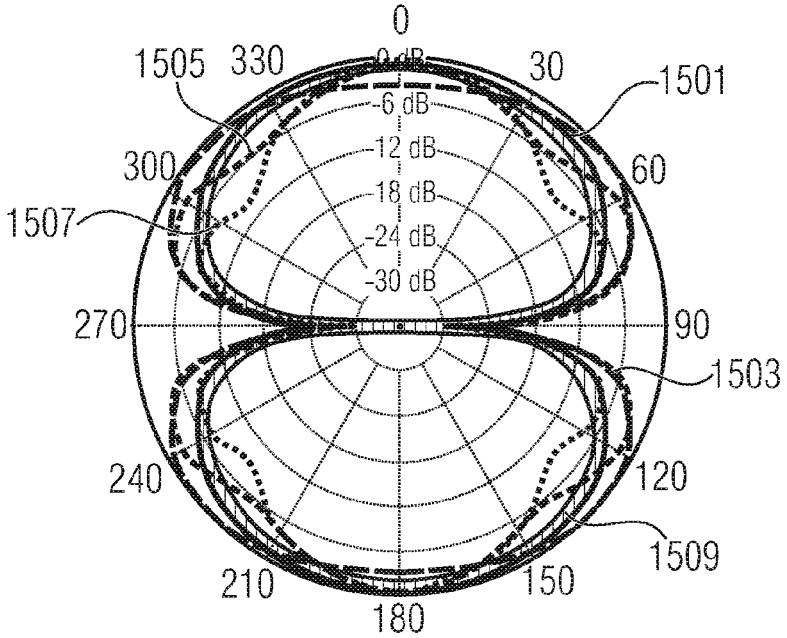
Figure 15C:
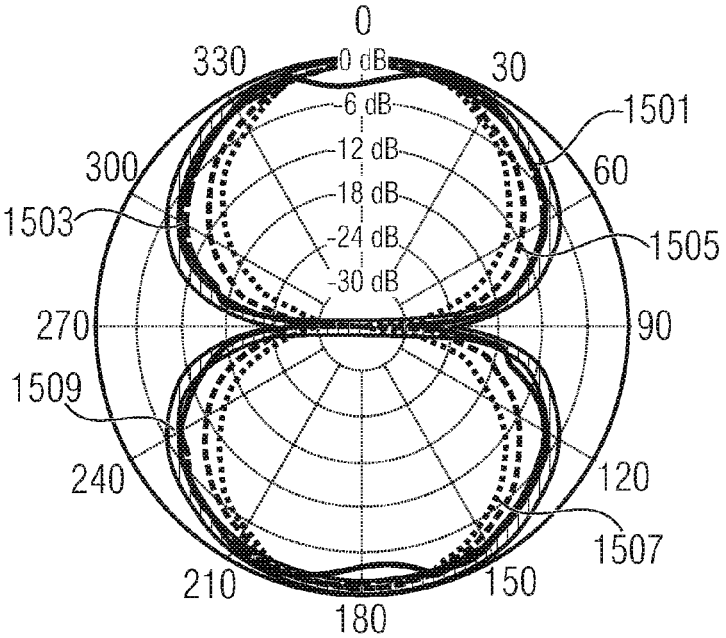

FIG. 14 and FIG. 15 show directional patterns with G.R.A.S and AKG microphones: 14*a*) energy of single microphone, 14*b*) pressure gradient between two microphones, and 14*c*) energy gradient between two microphones.

FIG. 14 shows logarithmic directional patterns based with G.R.A.S microphone. The patterns are normalized and plotted at third-octave bands with the center frequency of 8 kHz (curves with reference number 1401), 10 kHz (curves with reference number 1403), 12.5 kHz (curves with reference number 1405) and 16 kHz (curves with reference number 1407). The pattern for an ideal dipole with ±1 dB deviation is denoted with an area 1409 in 14*b*) and 14*c*).

FIG. 15 shows logarithmic directional patterns with AKG microphone. Patterns are normalized and plotted at third-octave band with the center frequencies of 5 kHz (curves with reference number 1501), 8 kHz (curves with reference number 1503), 12.5 kHz (curves with reference number 1505) and 16 kHz (curves with reference number 1507). The pattern for an ideal dipole with ±1 dB deviation is denoted with an area 1509 in 15*b*) and 15*d*).

The normalized patterns are plotted at some third-octave bands with the center frequencies starting close from the theoretical spatial-aliasing frequencies of 8575 Hz (G.R.A.S) and 5197 Hz (AKG). One should note that different center frequencies are used with G.R.A.S and AKG microphones. Besides, the directional pattern for an ideal dipole with ±1 dB deviation is denoted as the areas 1409, 1509 in the plots of the pressure and energy gradients. The patterns in FIG. 14 *a*) and FIG. 15 *a*) reveal that the individual omnidirectional microphone has a significant directivity at high frequencies, because of the shadowing. With G.R.A.S microphone and 2 cm spacing in the array, the dipole derived as the pressure gradient spread as a function of the frequency in FIG. 14 *b*). The energy gradient produces dipole patterns, but some narrower than the ideal one at 12.5 kHz and 16 kHz in FIG. 14 *c*). With AKG microphone and 3.3 cm spacing in the array, the directional pattern of the pressure gradient spread and distort at 8 kHz, 12.5 kHz and 16 kHz, whereas with the energy gradient, the dipole patterns decrease as a function of frequency, but resembling however the ideal dipole.

Figure 16A:
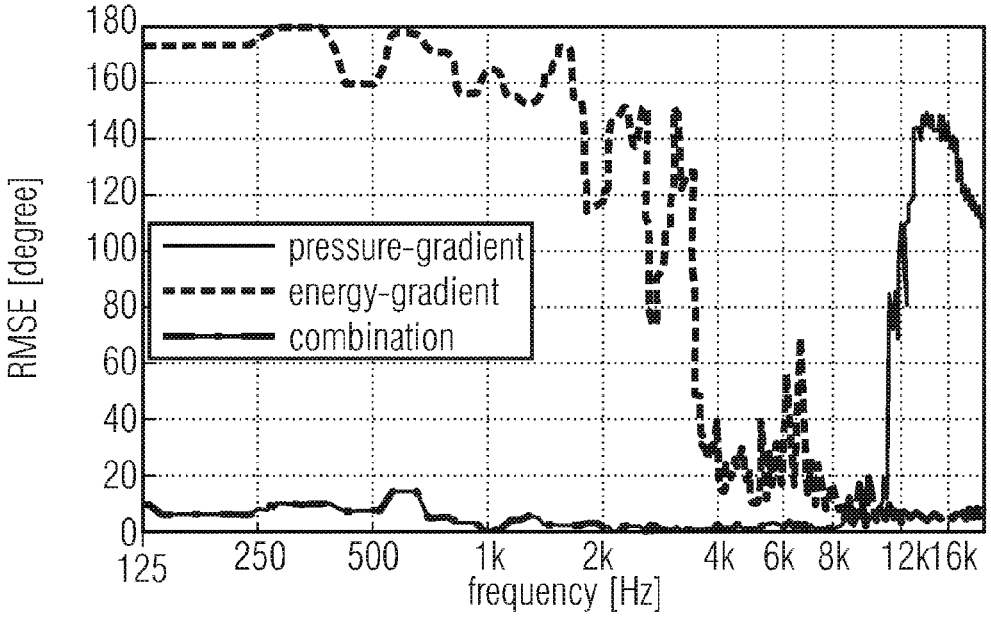
FIGS. 16A and 16B show diagram results for direction analysis expressed as root-mean-square error (RMSE).
Figure 16B:
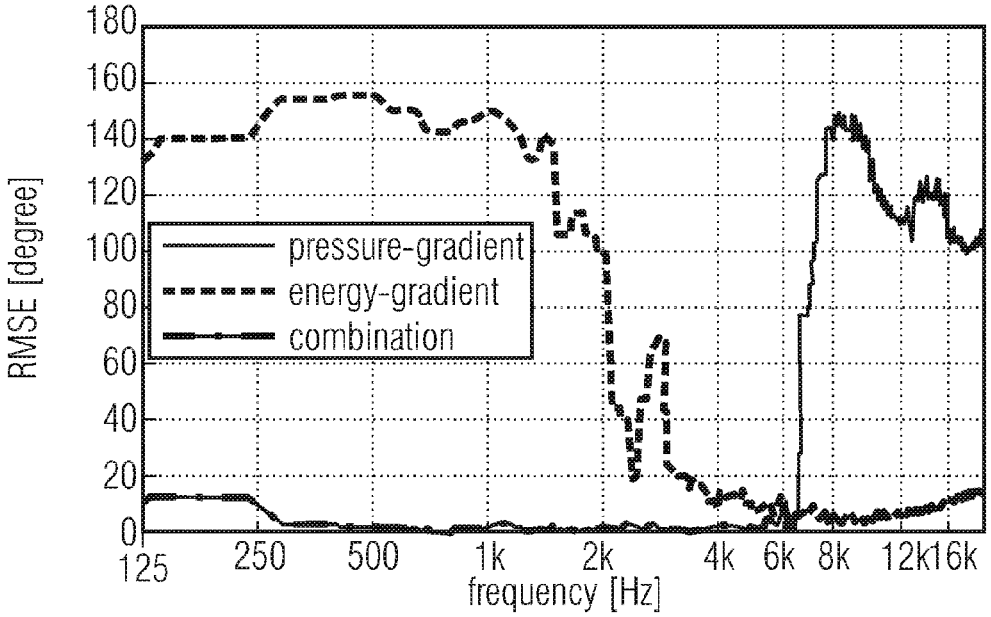

FIG. 16 shows the direction analysis results as root-mean square errors (RMSE) along the frequency, when the measured responses of G.R.A.S and AKG microphones were used to simulate microphone array in 16*a*) and 16*b*), respectively.

In FIG. 16 the direction was estimated using arrays of four omnidirectional microphones, which were modeled using measured impulse responses of real microphones.

The direction analyses were performed by convolving the impulse responses of the microphones at 0°, 5°, 10°, 15°, 20°, 25°, 30°, 35°, 40° and 45° alternatively with a white noise sample, and estimating the direction within 20 ms STFT-windows in DirAC analysis. The visual inspection of the results reveals that the direction is estimated accurately up to the frequencies of 10 kHz in 16*a*) and 6.5 kHz in 16*b*) utilizing the pressure gradients, and above such frequencies utilizing the energy gradients. Aforementioned frequencies are however some higher than the theoretical spatial-aliasing frequencies of 8575 Hz and 5197 Hz with the optimized microphone spacings of 2 cm and 3.3 cm, respectively. Besides, frequency ranges for valid direction estimation with both pressure and energy gradients exist at 8 kHz to 10 kHz with G.R.A.S microphone in 16*a*) and at 3 kHz to 6.5 kHz with AKG microphone in 16*b*). The microphone spacing optimization with given values seems to provide a good estimation in these cases.

5.5.7 Conclusion

This example presents a method/apparatus to analyze the arrival direction of sound at broad audio frequency range, when pressure and energy gradients between omnidirectional microphones are computed at low and high frequencies, respectively, and used to estimate the sound intensity vectors. The method/apparatus was employed with an array of four omnidirectional microphones facing opposite directions with relatively large diaphragm sizes, which provided the measurable inter-microphone level differences for computing the energy gradients at high frequencies.

It was shown that the presented method/apparatus provides reliable direction estimation at broad audio frequency range, whereas the conventional method/apparatus employing only the pressure gradients in energetic analysis of sound field suffered from spatial aliasing and produces thus highly erroneous direction estimation at high frequencies.

To summarize, the example showed the method/apparatus to estimate the direction of sound by computing sound intensity from pressure and energy gradients of closely spaced omnidirectional microphones frequency dependently. In other words, embodiments provide an apparatus and/or a method which is configured to estimate a directional information from a pressure and an energy gradient of closely spaced omnidirectional microphones frequency dependently. The microphones with relatively large diaphragms and causing shadowing for sound wave are used here to provide inter-microphone level differences large enough for computing energy gradients feasible at high frequencies. The example was evaluated in direction analysis of spatial sound processing technique, directional audio coding (DirAC). It was shown that the method/the apparatus provides reliable direction estimation information at full audio frequency range, whereas traditional methods employing only the pressure gradients produce highly erroneous estimation at high frequencies.

From this example it can be seen that in a further embodiment, a combiner of an apparatus according to this embodiment is configured to derive the directional information on the basis of the magnitude values and independent from the phases of the microphone signal or the components of the microphone signal in a first frequency range (for example above the spatial aliasing limit). Furthermore, the combiner may be configured to derive the directional information in dependence on the phases of the microphone signals or of the components of the microphone signal in a second frequency range (for example below the spatial aliasing limit). In other words, embodiments of the present invention may be configured to derive the directional information frequency selective, such that in a first frequency range the directional information is based solely on the magnitude of the microphone signals or the components of the microphone signal and in a second frequency range the directional information is further based on the phases of the microphone signals or of the components of the microphone signal.

6. Summary

To summarize, embodiments of the present invention estimate directional parameters of a sound field by considering (solely) the magnitudes of microphones spectra. This is especially useful in practice if the phase information of the microphone of the microphone signals is ambiguous, i.e., when spatial aliasing effects occur. In order to be able to extract the desired directional information, embodiments of the present invention (for example the system 900) use suitable configurations of directional microphones, which have different look directions. Alternatively (for example in the system 1000), objects can be included in the microphone configurations which cause direction dependent scattering and shading effects. In certain commercial microphones (e.g. large diaphragm microphones), the microphone capsules are mounted in relatively large housings. The resulting shadowing/scattering effect may already be sufficient to employ the concept of the present invention. According to further embodiments, the magnitude based parameter estimation performed by embodiments of the present invention can also be applied in combination with traditional estimation methods, which also consider the phase information of the microphone signals.

To summarize, embodiments provide a spatial parameter estimation via directional magnitude variations.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Apparatus for deriving directional information estimates from a plurality of microphone signals or from a plurality of components of a microphone signal, wherein different effective microphone look directions are associated with the microphone signals or the components, the apparatus comprising:

a combiner configured to:

acquire, for each time-frequency tile of a plurality of time-frequency tiles, a first magnitude value from a first microphone signal of the plurality of microphone signals or from a first component of the plurality of components of the microphone signal, acquire, for each time-frequency tile of the plurality of time-frequency tiles, a second magnitude value from a second microphone signal of the plurality of microphone signals or from a second component of the plurality of components of the microphone signal, provide a first direction information item describing an effective first microphone look direction associated with the first microphone signal of the plurality of microphone signals or with the first component of the plurality of components of the microphone signal, the first direction information item being a first vector pointing in the first effective microphone look direction, provide a second direction information item describing an effective second microphone look direction associated with the second microphone signal of the plurality of microphone signals or with the second component of the plurality of components of the microphone signal, the second direction information item being a second vector pointing in the second effective microphone look direction, wherein the first and second vectors are independent from the plurality of time frequency tiles, and linearly combine, for each time-frequency tile of the plurality of time-frequency tiles, the first vector weighted depending on the first magnitude value of the time-frequency tile and the second vector weighted depending on the second magnitude value of the time-frequency tile to derive, for each time-frequency tile of the plurality of time-frequency tiles, a result vector as the directional information estimate for each time-frequency tile;

wherein the effective first microphone look direction is different from the effective second microphone look direction.

2. Apparatus according to claim 1, wherein the combiner is configured to derive the directional information estimate for one of the plurality of time-frequency tiles as an estimate of a vector pointing towards the direction from which a sound is propagating at a frequency value and a time value associated with the one of the plurality of time-frequency tiles.

3. Apparatus according to claim 1, wherein the first or the second vector pointing in the first or second effective microphone look direction describes a direction, where a microphone from which the microphone signal is derived comprises its maximum response.

4. Apparatus according to claim 1, wherein the combiner is configured to acquire the first or second magnitude value for a time-frequency tile such that the first or second magnitude value describes a magnitude of a spectral coefficient representing the time frequency tile of the microphone signal.

5. Apparatus according to claim 1, wherein the combiner is configured to acquire a squared magnitude value based on the magnitude value, the squared magnitude value describing a power of the microphone signal or of the component of the microphone signal, and wherein the combiner is configured to combine the direction information items such that a direction information item is weighted in dependence on the squared magnitude value of the microphone signal or of the component of the microphone signal associated with the given effective microphone look direction.

6. Apparatus according to claim 1, wherein the combiner is configured to derive the directional information estimate according to the following equation:

$$d(k, n) = \sum_{i=1}^{N} |P_i(k, n)|^{\kappa} \cdot b_i, \tag{6}$$

in which d(k, n) denotes the directional information estimate for the given time frequency tile defined by (k,n), k is a frequency index, n is a time index, $P_i(k, n)$ denotes a microphone signal of an i-th microphone or a component of the microphone signal of the i-th microphone for the given time frequency tile, κ denotes an exponent value and $b_i$ denotes a vector describing the effective microphone look direction of the i-th microphone, i being equal to 1 for the first microphone signal or the first component, and i being equal to 2 for the second microphone signal or the second component.

7. Apparatus according to claim 6, wherein $\kappa>0$.

8. Apparatus according to claim 1, wherein the combiner is configured to derive the directional information estimates on the basis of the magnitude values and independent from phases of the microphone signals or of the components of the microphone signal in a first frequency range; and wherein the combiner is further configured to derive the directional information estimates in dependence on the phases of the microphone signals or of the components of the microphone signal in a second frequency range.

9. Apparatus according to claim 1, wherein the combiner is configured such that the direction information item is weighted solely in dependence on the magnitude value.

10. System comprising:

an apparatus for deriving directional information estimates from a plurality of microphone signals or from a plurality of components of a microphone signal, wherein different effective microphone look directions are associated with the microphone signals or the components, the apparatus comprising:

a combiner configured to:

acquire, for each time-frequency tile of a plurality of time-frequency tiles, a first magnitude value from a first microphone signal of the plurality of microphone signals or from a first component of the plurality of components of the microphone signal, acquire, for each time-frequency tile of the plurality of time-frequency tiles, a second magnitude value from a second microphone signal of the plurality of microphone signals or from a second component of the plurality of components of the microphone signal, provide a first direction information item describing an effective first microphone look direction associated with the first microphone signal of the plurality of microphone signals or with the first component of the plurality of components of the microphone signal, the first direction information item being a first vector pointing in the first effective microphone look direction, provide a second direction information item describing an effective second microphone look direction associated with the second microphone signal of the plurality of microphone signals or with the second component of the plurality of components of the microphone signal, the second direction information item being a second vector pointing in the second effective microphone look direction, wherein the first and second vectors are independent from the plurality of time frequency tiles, and linearly combine, for each time-frequency tile of the plurality of time-frequency tiles, the first vector weighted depending on the first magnitude value of the time-frequency tile and the second vector weighted depending on the second magnitude value of the time-frequency tile to derive, for each time-frequency tile of the plurality of time-frequency tiles, a result vector as the directional information estimate for each time-frequency tile;

a first directional microphone comprising the first effective microphone look direction for deriving the first microphone signal of the plurality of microphone signals, the first microphone signal being associated with the first effective microphone look direction; and a second directional microphone comprising the second effective microphone look direction for deriving the second microphone signal of the plurality of microphone signals, the second microphone signal being associated with the second effective microphone look direction; and wherein the effective first microphone look direction is different from the effective second microphone look direction.

11. System comprising:

an apparatus for deriving a directional information estimate from a plurality of microphone signals or from a plurality of components of a microphone signal, wherein different effective microphone look directions are associated with the microphone signals or the components, the apparatus comprising:

a combiner configured to:

acquire, for each time-frequency tile of a plurality of time-frequency tiles, a first magnitude value from a first microphone signal of the plurality of microphone signals or from a first component of the plurality of components of the microphone signal, acquire, for each time-frequency tile of the plurality of time-frequency tiles, a second magnitude value from a second microphone signal of the plurality of microphone signals or from a second component of the plurality of components of the microphone signal, provide a first direction information item describing an effective first microphone look direction associated with the first microphone signal of the plurality of microphone signals or with the first component of the plurality of components of the microphone signal, the first direction information item being a first vector pointing in the first effective microphone look direction, provide a second direction information item describing an effective second microphone look direction associated with the second microphone signal of the plurality of microphone signals or with the second component of the plurality of components of the microphone signal, the second direction information item being a second vector pointing in the second effective microphone look direction, wherein the first and second vectors are independent from the plurality of time frequency tiles, and linearly combine, for each time-frequency tile of the plurality of time-frequency tiles, the first vector weighted depending on the first magnitude value of the time-frequency tile and the second vector weighted depending on the second magnitude value of the time-frequency tile to derive, for each time-frequency tile of the plurality of time-frequency tiles, a result vector as the directional information estimate for each time-frequency tile;

a first omnidirectional microphone that derives the first microphone signal of the plurality of microphone signals;

a second omnidirectional microphone that derives the second microphone signal of the plurality of microphone signals; and a shadowing object placed between the first omnidirectional microphone and the second omnidirectional microphone for shaping effective response patterns of the first omnidirectional microphone and of the second omnidirectional microphone, such that a shaped effective response pattern of the first omnidirectional microphone comprises the first effective microphone look direction and a shaped effective response pattern of the second omnidirectional microphone comprises the second effective microphone look direction, the second effective microphone look direction being different from the first effective microphone look direction.

12. System according to claim 11, wherein the first and second omnidirectional microphones are arranged such that a sum of direction information items being vectors pointing in the effective microphone look directions equals zero within a tolerance range of ±30% of the norm of one of the direction information items.

13. Method for deriving directional information estimates from a plurality of microphone signals or from a plurality of components of a microphone signal, wherein different effective microphone look directions are associated with the microphone signals or the components, the method comprising:

acquiring, for each time-frequency tile of a plurality of time-frequency tiles, a first magnitude value from a first microphone signal of the plurality of microphone signals or from a first component of the plurality of components of the microphone signal;

acquiring, for each time-frequency tile of the plurality of time-frequency tiles, a second magnitude value from a second microphone signal of the plurality of microphone signals or from a second component of the plurality of components of the microphone signal, providing a first direction information item describing an effective first microphone look direction associated with the first microphone signal of the plurality of microphone signals or with the first component of the plurality of components of the microphone signal, the first direction information item being a first vector pointing in the first effective microphone look direction, providing a second direction information item describing an effective second microphone look direction associated with the second microphone signal of the plurality of microphone signals or with the second component of the plurality of components of the microphone signal, the second direction information item being a second vector pointing in the second effective microphone look direction, wherein the first and second vectors are independent from the plurality of time frequency tiles, and linearly combining, for each time-frequency tile of the plurality of time-frequency tiles, the first vector weighted depending on the first magnitude value of the time-frequency tile and the second vector weighted depending on the second magnitude value of the time-frequency tile to derive, for each time-frequency tile of the plurality of time-frequency tiles, a result vector as the directional information estimate for each time-frequency tile;

wherein the effective first microphone look direction is different from the effective second microphone look direction.

14. A non-transitory computer readable medium including a computer program comprising a program code for, when running on a computer, performing the method for deriving directional information estimates from a plurality of microphone signals or from a plurality of components of a microphone signal, wherein different effective microphone look directions are associated with the microphone signals or the components, the method comprising:

acquiring, for each time-frequency tile of a plurality of time-frequency tiles, a first magnitude value from a first microphone signal of the plurality of microphone signals or from a first component of the plurality of components of the microphone signal;

acquiring, for each time-frequency tile of the plurality of time-frequency tiles, a second magnitude value from a second microphone signal of the plurality of microphone signals or from a second component of the plurality of components of the microphone signal, providing a first direction information item describing an effective first microphone look direction associated with the first microphone signal of the plurality of microphone signals or with the first component of the plurality of components of the microphone signal, the first direction information item being a first vector pointing in the first effective microphone look direction, providing a second direction information item describing an effective second microphone look direction associated with the second microphone signal of the plurality of microphone signals or with the second component of the plurality of components of the microphone signal, the second direction information item being a second vector pointing in the second effective microphone look direction, wherein the first and second vectors are independent from the plurality of time frequency tiles, and linearly combining, for each time-frequency tile of the plurality of time-frequency tiles, the first vector weighted depending on the first magnitude value of the time-frequency tile and the second vector weighted depending on the second magnitude value of the time-frequency tile to derive, for each time-frequency tile of the plurality of time-frequency tiles, a result vector as the directional information estimate for each time time-frequency tile;

wherein the effective first microphone look direction is different from the effective second microphone look direction.

15. System according to claim 10, wherein the first and second directional microphones are arranged such that a sum of direction information items being vectors pointing in the effective microphone look directions equals zero within a tolerance range of ±30% of the norm of one of the direction information items.

* * * * *